US008249471B2

(12) United States Patent
Kawahara

(10) Patent No.: US 8,249,471 B2
(45) Date of Patent: Aug. 21, 2012

(54) IMAGE FORMING APPARATUS HAVING WASTE TONER DETECTING MECHANISM

(75) Inventor: Eiji Kawahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 217 days.

(21) Appl. No.: 12/731,190

(22) Filed: Mar. 25, 2010

(65) Prior Publication Data

US 2010/0247119 A1 Sep. 30, 2010

(30) Foreign Application Priority Data

Mar. 31, 2009 (JP) ..... 2009-084944
Mar. 31, 2009 (JP) ..... 2009-085186

(51) Int. Cl.
*G03G 15/00* (2006.01)
*G03G 21/12* (2006.01)

(52) U.S. Cl. ..... 399/35; 399/27; 399/101

(58) Field of Classification Search ..... 399/35, 399/27, 12, 101, 120
See application file for complete search history.

(56) References Cited

U.S. PATENT DOCUMENTS

| | | | | |
|---|---|---|---|---|
| 2007/0230973 | A1* | 10/2007 | Takahashi | 399/27 |
| 2008/0317484 | A1* | 12/2008 | Tanimoto et al. | 399/35 |
| 2009/0116853 | A1* | 5/2009 | Okazaki et al. | 399/12 |

FOREIGN PATENT DOCUMENTS

| | | | |
|---|---|---|---|
| JP | 2003-066801 | | 3/2003 |
| JP | 2005077562 | A | 3/2005 |
| JP | 2005-331663 | | 12/2005 |
| JP | 2006038692 | A | 2/2006 |
| JP | 2007101572 | A | 4/2007 |
| JP | 2008-134279 | A | 6/2008 |
| JP | 2008145912 | A | 6/2008 |
| JP | 2008225370 | A | 9/2008 |
| JP | 2009-008815 | | 1/2009 |
| JP | 2009-008820 | | 1/2009 |
| JP | 2009-063772 | A | 3/2009 |

OTHER PUBLICATIONS

Japanese Office Action mailed Mar. 15, 2011 in Application No. 2009-084944 and English translation thereof.

* cited by examiner

*Primary Examiner* — Sophia S Chen
(74) *Attorney, Agent, or Firm* — Banner & Witcoff, Ltd.

(57) ABSTRACT

A first moving member is provided in conjunction with a toner container collecting toner not transferred on the recording medium and moves in accordance with the movement of a toner conveying unit. A second moving member is provided in conjunction with the toner container and moves in accordance with an amount of the toner accumulated in the toner container. The toner conveying unit conveys the toner toward the second moving member. A detecting unit outputs a detection signal that changes depending on the movements of the first moving member and the second moving member. A determining unit determines, based on the detection signal, whether or not at least one of the driving force supplying unit and the toner conveying unit is in an abnormal condition and whether or not the amount of the toner accumulated in the toner container has reached a predetermined accumulation level.

19 Claims, 17 Drawing Sheets

IMAGE FORMING APPARATUS HAVING WASTE TONER DETECTING MECHANISM

CROSS REFERENCE TO RELATED APPLICATION

This application claims priority from Japanese Patent Application Nos. 2009-084944 filed Mar. 31, 2009, and 2009-085186 filed Mar. 31, 2009. The entire content of each of these priority applications is incorporated herein by reference.

TECHNICAL FIELD

The present invention relates to an image forming apparatus.

BACKGROUND

One image forming apparatus forms images on a recording medium by transferring a toner image onto the recording medium. Such one conventional image forming apparatus is provided with a waste toner container that accommodates waste toner therein, and a conveying screw disposed within the waste toner container.

The conveying screw includes a rotational shaft and a blade. The rotational shaft is rotatably supported to a pair of side walls of the waste toner container, and the blade is provided on and around the rotational shaft in a spiral manner. The rotational shaft has an end protruding from one side wall, and another end connected to a drive source. There is disposed a coil spring between the other side wall of the waste toner container and the blade. The coil spring is compressed and biases the blade of the conveying screw toward the one side wall.

In such one image forming apparatus, when the conveying screw rotates about the rotational shaft upon receipt of driving force from the drive source, waste toner is conveyed from one side to the other side within the waste toner container. If the conveying screw of the rotational shaft is broken, the end of the rotational shaft is pushed further outward from the one side wall of the waste toner container, due to the resilient force of the coil spring. The rotational motion of the rotational shaft is detected by a sensor, thereby enabling the conveying screw to be detected as being damaged.

Another image forming apparatus forms images on a recording medium by transferring a toner image onto the recording medium. Such another conventional image forming apparatus is provided with a waste toner container that accommodates waste toner therein, a moving member that moves in accordance with the accumulation of the waste toner within the waste toner container, a detection unit that outputs detection results corresponding to the motion of the moving member, and a determination unit that determines whether or not the waste toner has accumulated up to a prescribed accumulation level based on the detection results.

The detection unit includes a light emitting section and a light receiving section disposed in separation from and in opposition to the light emitting section. The detection unit detects whether or not a light path formed between the light emitting section and the light receiving section is blocked. The detection unit is provided at a position outside of the waste toner container.

The moving member includes a connection section, a receiving section and a shielding section. The connection section has a rod-like shape, extending in a horizontal direction. The connection section is pivotably supported within the waste toner container. The connection section has one end protruding outside from the waste toner container. The receiving section has a plate shape and protrudes downward from the connection section within the waste toner container. The shielding section is connected to the one end of the connection section outside of the waste toner container. The shielding section is configured to pivotally move integrally with the receiving section within the waste toner container, thereby either blocking or releasing the light path.

In this another image forming apparatus, in accordance with the increase in the accumulation of the waste toner, the receiving section is pushed upward so that an inclination angle of the receiving section relative to a vertical direction can increase. Accordingly, the shielding section also pivotally moves via the connection section, moving from a position to block the light path to a position to release the same. As a response, the detection unit detects that the light path is now not blocked, based on which the determination unit determines that the waste toner has accumulated up to the prescribed accumulation level within the waste toner container.

SUMMARY

However, the above-described one conventional image forming apparatus only allows detection of the damage to the conveying screw itself. If there exists any power transmission member between the conveying screw and the drive source, trouble occurring at a position upstream of the conveying screw cannot be detected. Therefore, another mechanism for detecting a problem that happens upstream of the conveying screw is required, leading to complication of the configuration of the one image forming apparatus.

Further, another mechanism for detecting an accumulation level of the waste toner in the waste toner container is required, leading to complication of the one image forming apparatus.

Further, however, in the above-described another conventional image forming apparatus, since the inclination angle of the receiving section slowly increases in response to the gradual increase in the accumulation of the waste toner, the shielding section also makes a slow pivotal movement, thereby only slowly shifting to such a position where the light path is released from a position where the light path is blocked. Therefore, transitional state from the light blocking position of the shielding section to the light releasing position of the shielding section inevitably becomes longer, and the timing at which the detection unit detects the releasing of the light path tends to vary. With such a configuration, the determination unit may not be able to make an accurate determination on whether or not the waste toner has been accumulated to the prescribed accumulation level within the waste toner container.

In view of the foregoing, it is an object of the present invention to provide a simple-structured image forming apparatus and to provide an image forming apparatus capable of determining that waste toner has been accumulated to a certain level with high accuracy.

In order to attain the above and other objects, there is provided an image forming apparatus including: an image forming unit, a toner container, a driving force supplying unit, a toner conveying unit, a first moving member, a second moving member, a detecting unit, and a determining unit. The image forming unit transfers toner onto a recording medium to form an image thereon. The toner container collects toner not transferred on the recording medium. The driving force supplying unit supplies a driving force. The toner conveying unit receives the driving force from the driving force supplying unit and moves to convey the toner accumulated in the toner container. The first moving member is provided in conjunction with the toner container and moves in accordance with the movement of the toner conveying unit. The second moving member is provided in conjunction with the toner container and moves in accordance with an amount of the toner accumulated in the toner container. The toner conveying unit conveys the toner toward the second moving member. The detecting unit outputs a detection signal that changes depending on the movements of the first moving member and the second moving member. The determining unit determines, based on the detection signal, whether or not at least one of the driving force supplying unit and the toner conveying unit is in an abnormal condition and whether or not the amount of the toner accumulated in the toner container has reached a predetermined accumulation level.

According to anther aspect of the present invention, there is provided an image forming apparatus an image forming unit, a toner container, a driving force supplying unit a toner conveying unit, a driving force transmission unit, a moving member, a detecting unit, and a determining unit. The image forming unit that transfers toner onto a recording medium to form an image thereon. The toner container collects toner not transferred on the recording medium. The driving force supplying unit supplies a driving force. The toner conveying unit receives the driving force from the driving force supplying unit and moves to convey the toner accumulated in the toner container. The driving force transmission unit receives the driving force via the toner conveying unit. The moving member is provided in conjunction with the toner container and is driven by the driving force transmission unit to move in accordance with an amount of the toner accumulated in the toner container and the movement of the toner conveying unit. The toner conveying unit conveys the toner toward the moving member. The detecting unit outputs a detection result that changes depending on the movements of the moving member. The determining unit determines, based on the detection result, whether or not the amount of the toner accumulated in the toner container has reached a predetermined accumulation level. The detecting unit includes a light emitting portion emitting a light and a light receiving portion receiving the light emitted from the light emitting portion. A light path is formed between the light emitting portion and the light receiving portion. The moving member includes a receiving section, a shielding section that is configured to periodically move between a first position blocking the light path and a second position allowing the light path to be formed between the light emitting portion and light receiving portion, and a connecting section that connects the receiving section and the shielding section. The receiving section is configured to periodically move between a third position and a fourth position by being driven by the driving force transmission unit if the amount of the toner accumulated in the toner container fail to reach a predetermined accumulation level. The receiving section is configured to be positioned at the fourth position without being driven by the driving force transmission unit if the amount of the toner accumulated in the toner container has reached a predetermined accumulation level. The shielding section is configured to move in conjunction with the movement of the receiving section to periodically block the light path if the receiving section is movable between the third position and the fourth position, and the shielding section is configured to be positioned at either one of the first position and the second position if the receiving section is positioned at the fourth position.

DETAILED DESCRIPTION

Figure 1:
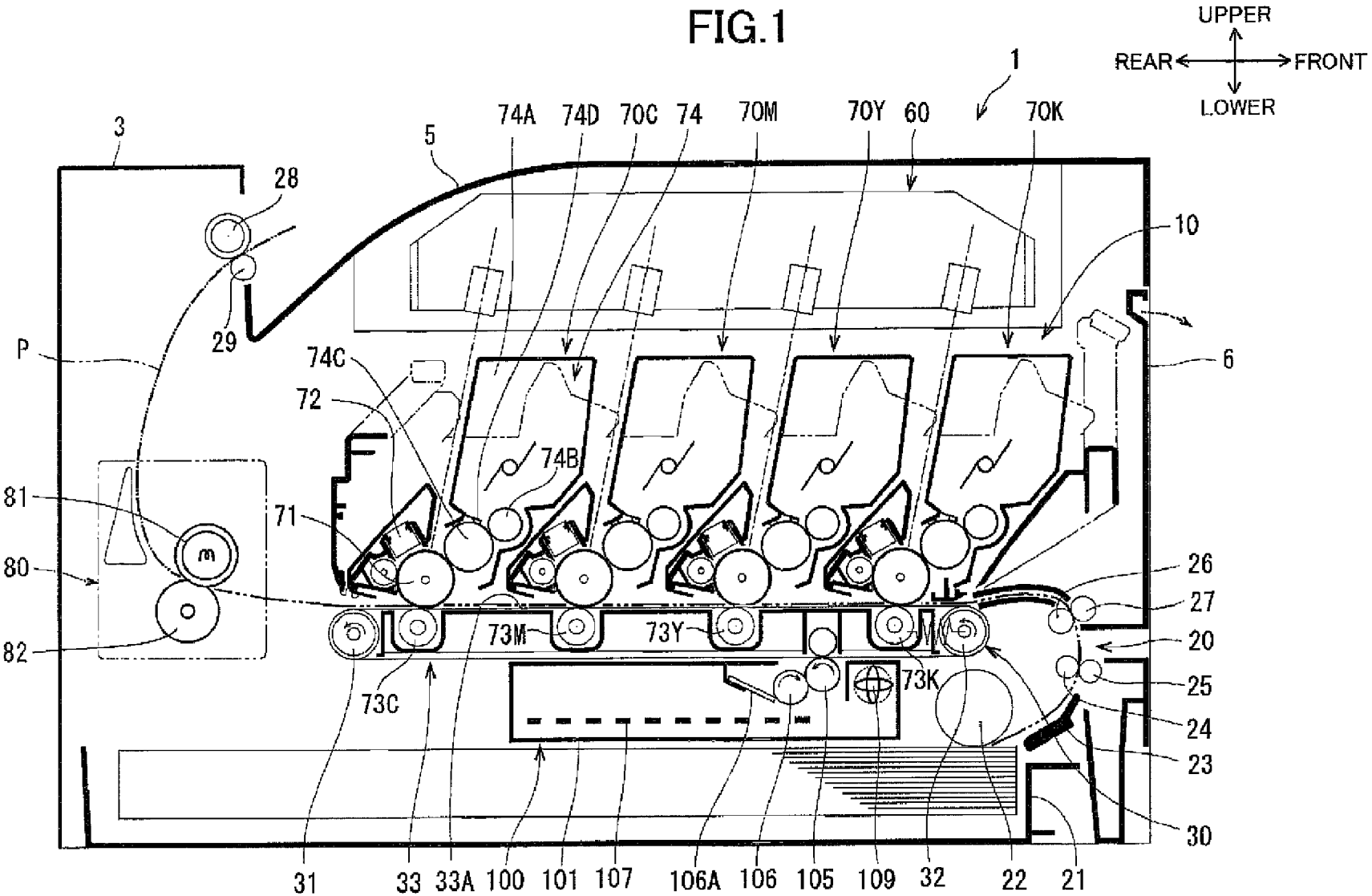
FIG. 1 is a cross-sectional view showing a general configuration of a printer according to a first embodiment of the present invention.

First, a printer 1 according to a first embodiment of the present invention will be described with reference to FIGS. 1 through 20. In FIG. 1, the right side of the printer 1 is defined as the "front side" of the printer 1, and the left side of the printer 1 is defined as the "rear side" of the printer 1. Further, the left side of the printer 1 when viewed from the front side (i.e., a direction from a reverse side of paper on which FIG. 1 is drawn to an obverse side of the paper) is defined as the "left side" of the printer 1, while the right side of the printer 1 when viewed from the front side (i.e., a direction from the obverse side of the paper to the reverse side of the paper) is defined as the right side. In the following description, each direction of front, rear, left, right, upper and lower will be referred to as those defined as above. Every direction in all figures will be shown in association with those shown in FIG. 1.

The printer 1 is an electrophotographic color laser printer, forming images in a plurality of colors on sheets (including OHP sheets). First, a general configuration of the printer 1 will be described with reference to FIG. 1.

1. Configuration of Printer

As shown in FIG. 1, the color printer 1 has a housing 3 that is a substantially box shape within which a frame member (now shown) is provided. The printer 1 includes a sheet feeding unit 20, an image forming unit 10, a conveying unit 30, a fixing unit 80 and a waste toner collection unit 100, all of which are disposed within (assembled to) the frame member. The image forming unit 10 is disposed at a position substantially center in the housing 3.

The housing 3 is formed with a sheet discharge tray 5 at an upper surface thereof. Sheets on which images are formed are to be discharged onto the sheet discharge tray 5 via a pair of discharge rollers 28 and 29, as shown in FIG. 1. The housing 3 is also provided with a front cover 6 at a front side thereof. The front cover 6 is supported to the housing 3 so as to be pivotably movable about a pivot shaft (not shown) disposed at a bottom portion of the housing 3. The image forming unit 10 and the conveying unit 30 are detachably mountable on the frame member when the front cover 6 is opened. The waste toner collection unit 100 is also detachably mounted on the frame member when the image forming unit 10 and the conveying unit 30 are taken out. Conventional configurations are employed for detachably mounting the image forming unit 10, the conveying unit 30 and the waste toner collection unit 100 on the frame member, and therefore explanations therefor will be omitted.

2. Sheet Feeding Unit

A sheet conveying path P is shown in a solid two-dot chain line in FIG. 1. The sheet conveying path P initially extends forward from a sheet tray 21, and then changes a direction thereof rearward toward the image forming unit 10, while forming a substantially U-shape. The sheet conveying path P then extends further rearward from the image forming unit 10 until the fixing unit 80, but subsequently bends upward toward the discharge rollers 28 and 29, while forming a substantially U-shape. At the most downstream of the sheet conveying path P positioned is the sheet discharge tray 5.

The sheet feeding unit 20 includes the sheet tray 21, a sheet feed roller 22, a separation pad 23, a pair of conveying rollers 24 and 25, and a pair of registration rollers 26 and 27. The sheet tray 21 is detachably mounted on the bottom portion of the housing 3 for accommodating sheets therein. The sheet feed roller 22 is disposed above a front end portion of the sheet tray 21 and conveys the sheets accommodated in the sheet tray 21 to the conveying unit 30. The separation pad 23 applies resistance to the sheets conveyed from the sheet feed roller 22 and separates the sheets one by one.

The pair of conveying roller 24 and 25 is disposed at a position diagonally forward and upward of the separation pad 23 where the sheet conveying path P makes a first U-turn. The conveying rollers 24 and 25 apply conveying force to the sheets P that is conveyed to the image forming unit 10.

The registration rollers 26 and 27 are disposed downstream of the conveying rollers 24 and 25 in the sheet conveying path P. The registration rollers 26 and 27 correct skew of the sheets conveyed from the conveying rollers 24 and 25 by capturing the leading edge of each sheet, and subsequently convey the sheets to the image forming unit 10.

3. Conveying Unit

The conveying unit 30 is disposed at a position between the sheet tray 21 (below) and the image forming unit 10 (above). The conveying unit 30 includes a conveyor belt 33, a drive roller 31, a driven roller 32 and transfer rollers 73K, 73Y, 73M and 73C.

The conveyor belt 33 is an endless belt that is stretched around the drive roller 31 and the driven roller 32 under tension. The drive roller 31 is disposed rearward of and below the image forming unit 10, while the driven roller 32 is disposed forward of and below the image forming unit 10. Each of the drive roller 31 and the driven roller 32 has a rotational shaft extending in the left-to-right direction. As the drive roller 31 rotates synchronously with the registration rollers 26 and 27, the conveyor belt 33 circulates between the drive roller 31 and the driven roller 32. The conveyor belt 33 has an upper surface that is disposed immediately below the image forming unit 10 and extends in the substantially horizontal (i.e., front-to-rear) direction. This upper surface of the conveyor belt 33 is in contact with backside of each sheet, thereby serving as a sheet conveying surface 33A on which the sheets are conveyed.

The transfer rollers 73K through 73C are disposed within the loop of conveyor belt 33 so as to be in contact with the conveyor belt 33 from the backside of the sheet conveying surface 33A. The conveyor belt 33 is made of a conductive rubber, and therefore is charged with a negative polarity (transfer bias) that is applied to each of the transfer rollers 73K, 73Y, 73M and 73C. The conveyor belt 33 can therefore convey the sheets along the sheet conveying path P while adsorbing the sheets to the sheet conveying surface 33A with electrostatic force generated thereon.

4. Image Forming Unit

The image forming unit 10 is so-called a direct tandem type and forms images in colors. The image forming unit 10 includes four process cartridges 70K, 70Y, 70M and 70C and a scanner unit 60. The process cartridges 70K to 70C correspond to toner of four colors (black, yellow, magenta and cyan) respectively, and are juxtaposed to each other along the sheet conveying surface 33A from upstream to downstream in the sheet conveying path P.

4.1. Scanner Unit

The seamier unit 60 is disposed at a position uppermost within the housing 3. The scanner unit 60 includes a laser source, polygon mirrors, fθ lenses and reflection mirrors. The laser source emits a laser beam, which is then deflected by the polygon mirrors, passes through the fθ lenses and is reflected off and bent downward by the reflection mirrors. The laser beam finally irradiates respective surfaces of photosensitive drums 71 (described next) provided in each process cartridge 70K, 70Y, 70M and 70C, thereby forming electrostatic latent images thereon.

4.2. Process Cartridge

The process cartridges 70K, 70Y, 70M and 70C are of a configuration identical to each other. Hence, the configuration will be briefly described next by taking the process cartridge 70C as an example, with a further reference to FIG. 1.

The process cartridge 70C includes a well-known photosensitive drum 71, a charger 72 and a toner cartridge 74.

The photosensitive drum 71 is disposed at a position opposing the transfer roller 73C with the sheet conveying surface 33A interposed therebetween.

The toner cartridge 74 includes a toner accommodation chamber 74A, a supply roller 74B, a developing roller 74C and a thickness regulation blade 74D. The supply roller 74 accommodates toner therein. The toner is supplied to the developing roller 74C in accordance with rotation of the supply roller 74B, and is carried on the surface of the developing roller 74C. The toner is then formed into a thin layer of uniform thickness on the surface of the developing roller 74C by the thickness regulation blade 74D, and is supplied to the surface of the photosensitive drum 71.

5. Fixing Unit

The fixing unit 80 is disposed downstream of the process cartridges 70K, 70Y, 70M and 70C in the sheet conveying path P. The fixing unit 80 includes a heat roller 81 and a pressure roller 82. The heat roller 81 and the pressure roller 82 are disposed in opposition to each other so as to nip the sheet therebetween. The heat roller 81 synchronously rotates in conjunction with the rotation of the conveyor belt 33, while the pressure roller 82 rotates in accordance with the rotation of the heat roller 81. The heat roller 81 is in contact with the sheet from a side of the sheet on which images are formed, and applies heat on the toner on the sheet. The pressure roller 82 is in contact with the sheet from the other side thereof, applies pressure toward the heat roller 81. As the sheet passes the fixing unit 80, the toner transferred on the sheet is thermally fixed thereon and is conveyed further downstream along the sheet conveying path P toward the sheet discharge tray 5.

6. Image Forming Operation

In the printer 1 according to the first embodiment with the above-described configuration, an image is formed on the sheets as described below.

Upon starting an image forming operation, the sheet feeding unit 20 and the conveying unit 30 convey the sheet to the image forming unit 10. In the image forming unit 10, after each charger 72 uniformly charges corresponding surface of each photosensitive drum 71 with a positive polarity, a laser beam emitted from the scanner unit 60 exposes the surfaces of the photosensitive drums 71, thereby forming electrostatic latent images on each surface of the photosensitive drum 71 based on image data.

As each developing roller 74C rotates and opposes the photosensitive drum 71, toner supported on the surface of the developing roller 74C is supplied to the electrostatic latent image fowled on the corresponding photosensitive drum 71. The electrostatic latent image thus is made into a visible toner image on the surface of the photosensitive drum 71.

Each toner image supported on each photosensitive drum 71 is then transferred onto the sheet by a transfer bias applied to each transfer rollers 73K-73C. When the sheet is subsequently conveyed to the fixing unit 80, the toner image transferred on the sheet is thermally fixed thereon. Finally, the sheet is discharged onto the sheet discharge tray 5.

7. Waste Toner Collection Unit

When the printer 1 forms an image on the sheet, some of the toner supplied to the photosensitive drums 71 may not be transferred to the photosensitive drums 71 but may adhere to the conveyor belt 33. The toner not transferred to the sheet is treated as unnecessary (waste toner). If such waste toner remains on the conveyor belt 33, the waste toner may be re-transferred onto a subsequent sheet when the printer 1 performs an image forming operation next time, resulting in formation of an unintended image on the subsequent sheet. To this effect, the printer 1 is provided with the waste toner collection unit 100 for cleaning the waste toner deposited on the conveyor belt 33.

Hereinafter, a detailed configuration of the waste toner collection unit 100 will be described with reference to FIGS. 2 through 13.

Figure 2:
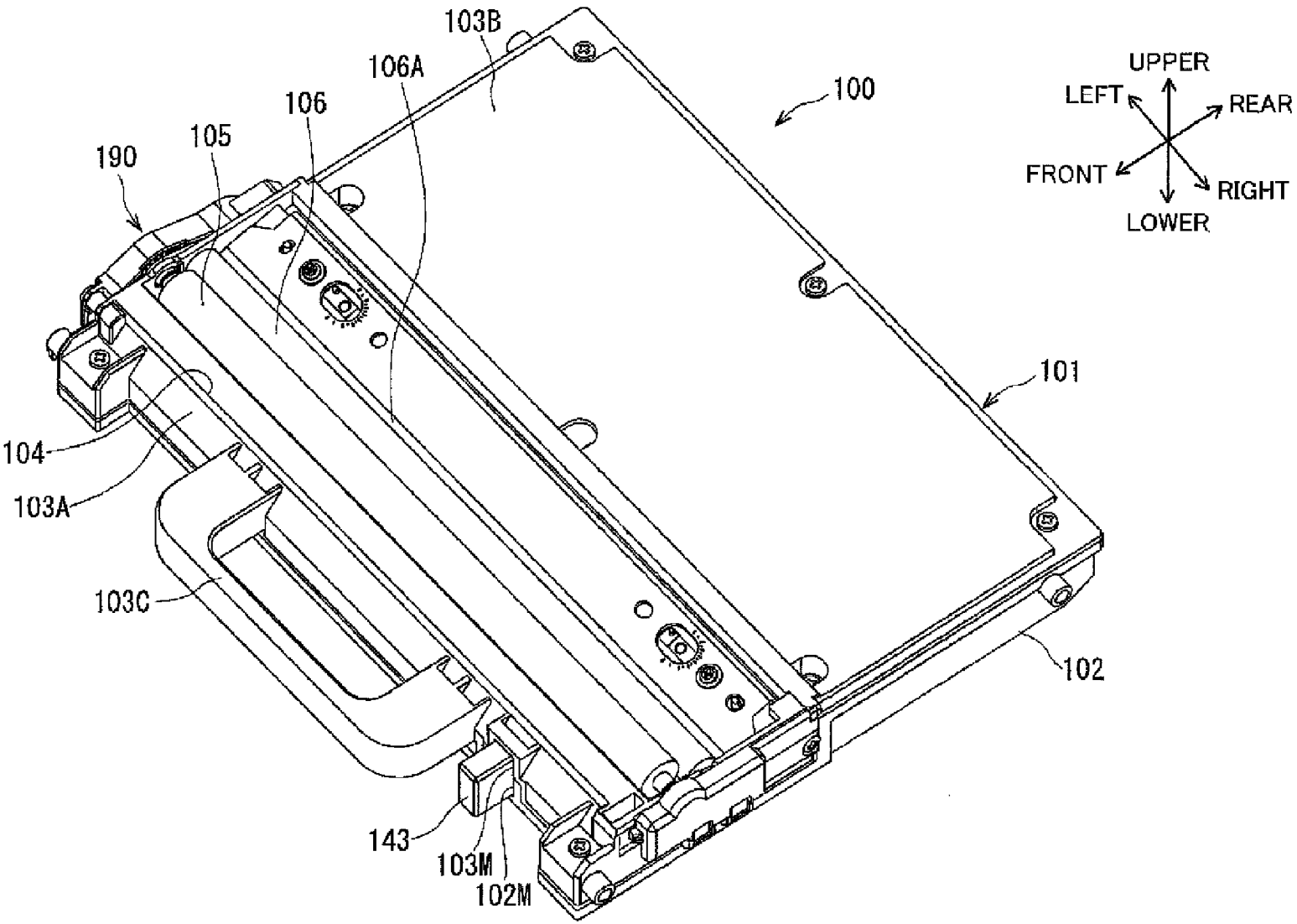
FIG. 2 is a perspective view of a waste toner collection unit of the printer according to the first embodiment of the present invention.

The waste toner collection unit 100 is disposed below the conveying unit 30 (see FIG. 1). The waste toner collection unit 100 includes a waste toner container 101 and a handle 103C. As shown in FIG. 2, the waste toner collection unit 100 has a substantially box shape and accommodates waste toner therein. The handle 103C is provided at a front portion of the waste toner container 101 so that a user can grip the handle 103C for detaching or mounting the waste toner collection unit 100 from or on the frame member of the housing 3.

Figure 3:
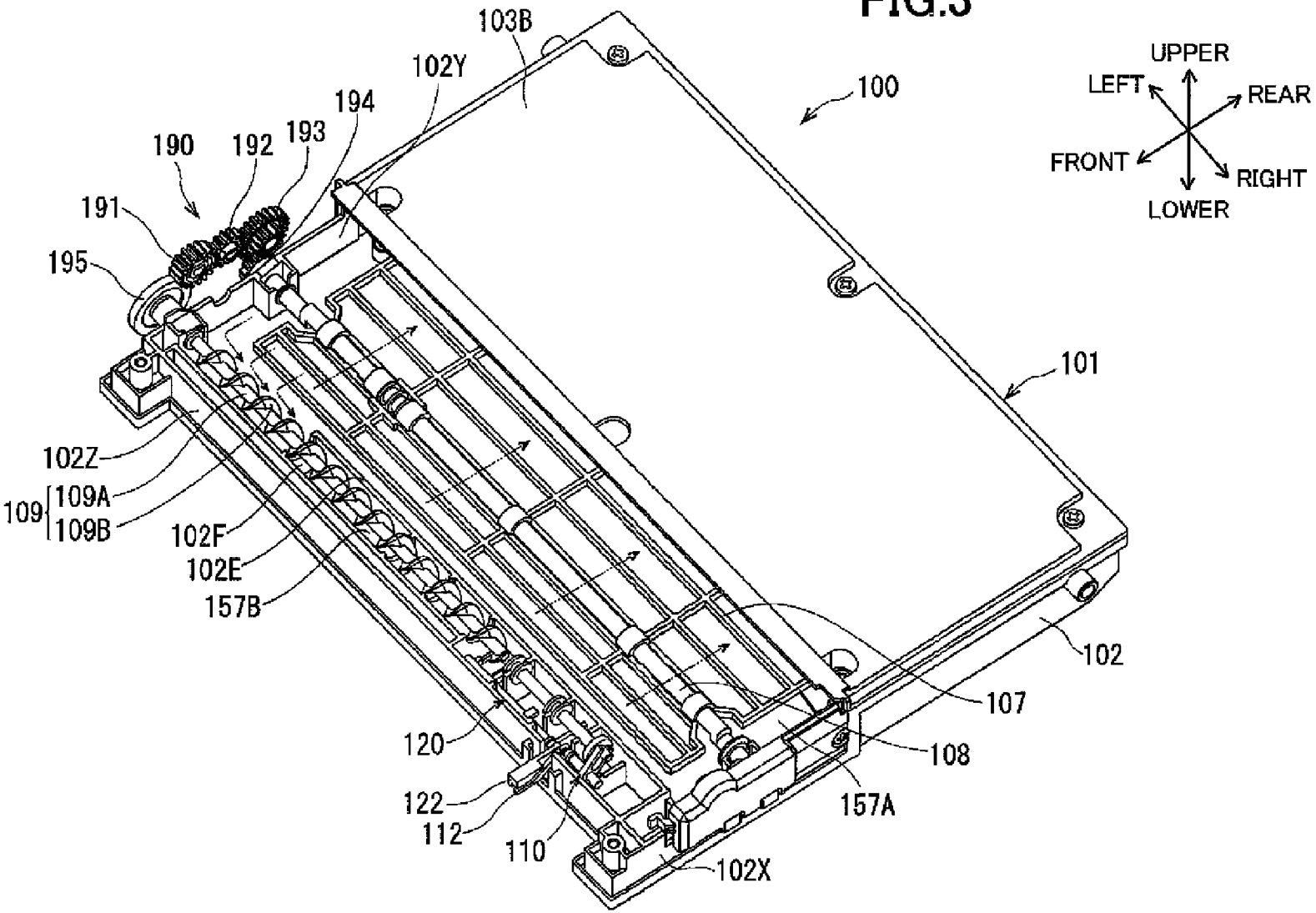
FIG. 3 is a perspective view of the waste toner collection unit according to the first embodiment of the present invention, in which a front upper cover, a cleaning roller and a scraping roller are removed.

The waste toner container 101 includes a container main body 102, a front upper cover 103A and a rear upper cover 103B. The container main body 102 is substantially box-shaped and has an open upper surface. The front upper cover 103A covers a front portion of the upper surface of the container main body 102, and the rear upper cover 103B covers a rear portion of the upper surface of the container main body 102, as shown in FIGS. 2 and 3. The front upper cover 103A and the rear upper cover 103B are assembled (fixed) to the container main body 102 with screws.

Figure 5:
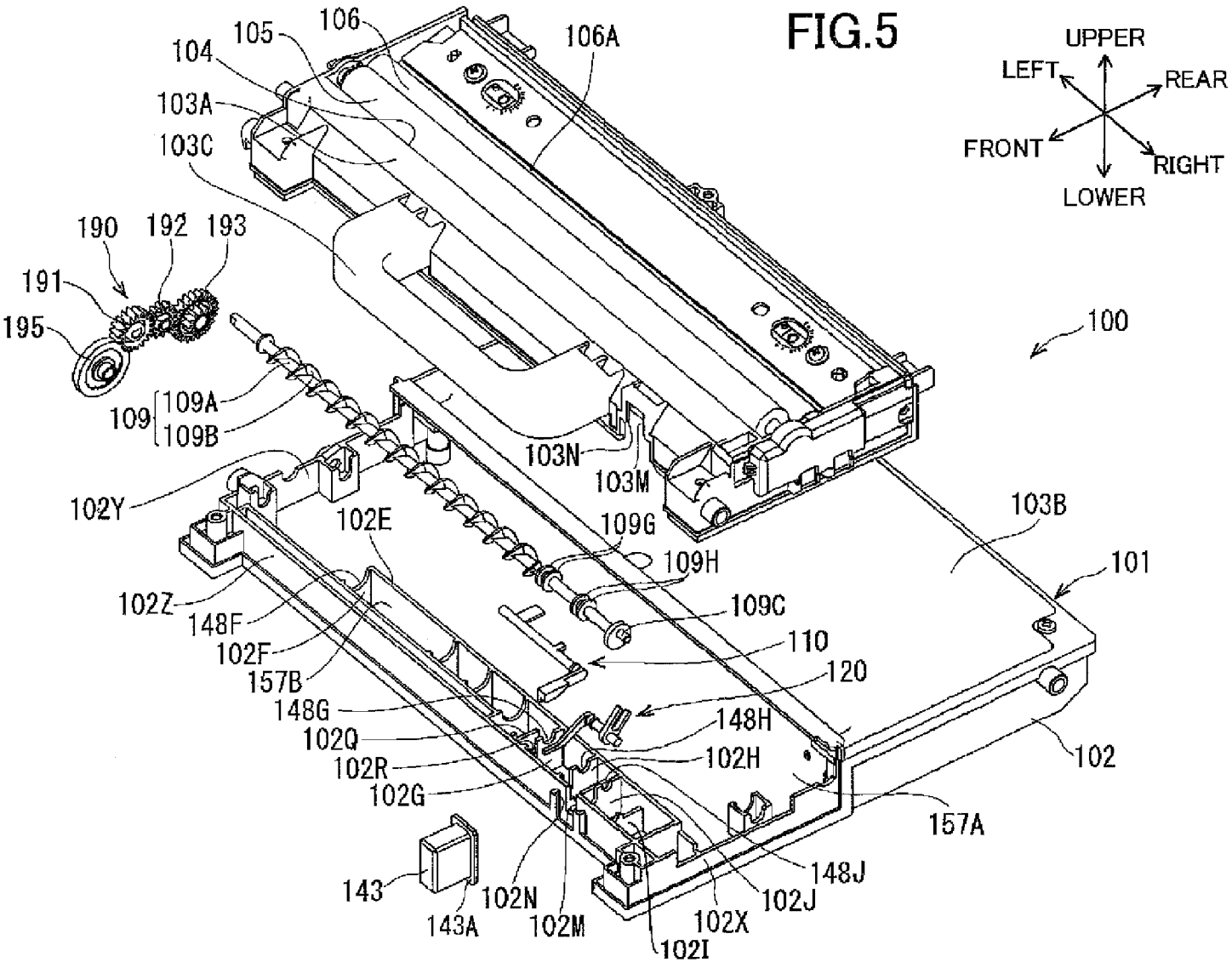
FIG. 5 is an exploded perspective view of the waste toner collection unit according to the first embodiment of the present invention.

The front upper cover 103A is formed with an opening 104, as shown in FIG. 5. The opening 104 has a width substantially identical to that of the conveyor belt 33 in the left-to-right direction. Within the opening 104, a cleaning roller 105, a scraping roller 106 and a separation blade 106A are arranged in the front-to-rear direction.

The cleaning roller 105 is a solid cylindrical-shaped roller whose outer surface is covered with a sponge layer made of a resin material. The cleaning roller 105 has a rotational shaft extending in a direction parallel to the rotational shafts of the drive roller 31 and the driven roller 32 in the conveying unit 30 (i.e., in the left-to-right direction). The cleaning roller 105 is rotatably supported to the front upper cover 103A. When the waste toner collection unit 100 is mounted on the frame member, the cleaning roller 105 contacts the conveyor belt 33 at a position below the conveyor belt 33.

The scraping roller 106 has a solid cylindrical shape and is made of a metal. The scraping roller 106 is in contact with the cleaning roller 105 at a position rearward of the cleaning roller 105 in the front-to-rear direction. The scraping roller 106 has a rotational shaft extending in a direction parallel to the cleaning roller 105 and is rotatably supported to the front upper cover 103A.

The separation blade 106A is formed of a soft urethane sheet and has a strip-like shape extending in the left-to-right direction. The separation blade 106A has a free end that is in contact with the scraping roller 106, and a base end that is fixed to a rear end portion of the opening 104, as shown in FIG. 1.

As shown in FIG. 2, the waste toner container 101 is provided with a power transmission mechanism 190 at a left side of the cleaning roller 105 in the left-to-right direction.

Specifically, as shown in FIG. 3, the power transmission mechanism 190 includes a plurality of gears 191, 192, 193, 194 and 195. Although not shown, the gear 191 is connected to the left end of the rotational shaft of the cleaning roller 105 so that the cleaning roller 105 can rotate synchronously with the rotation of the gear 191. The gear 192 is meshingly engaged with the gear 191 and is, although not shown either, connected to the left end of the rotational shaft of the scraping roller 106 so that the scraping roller 106 can rotate in conjunction with the rotation of the gear 192.

Figure 4:
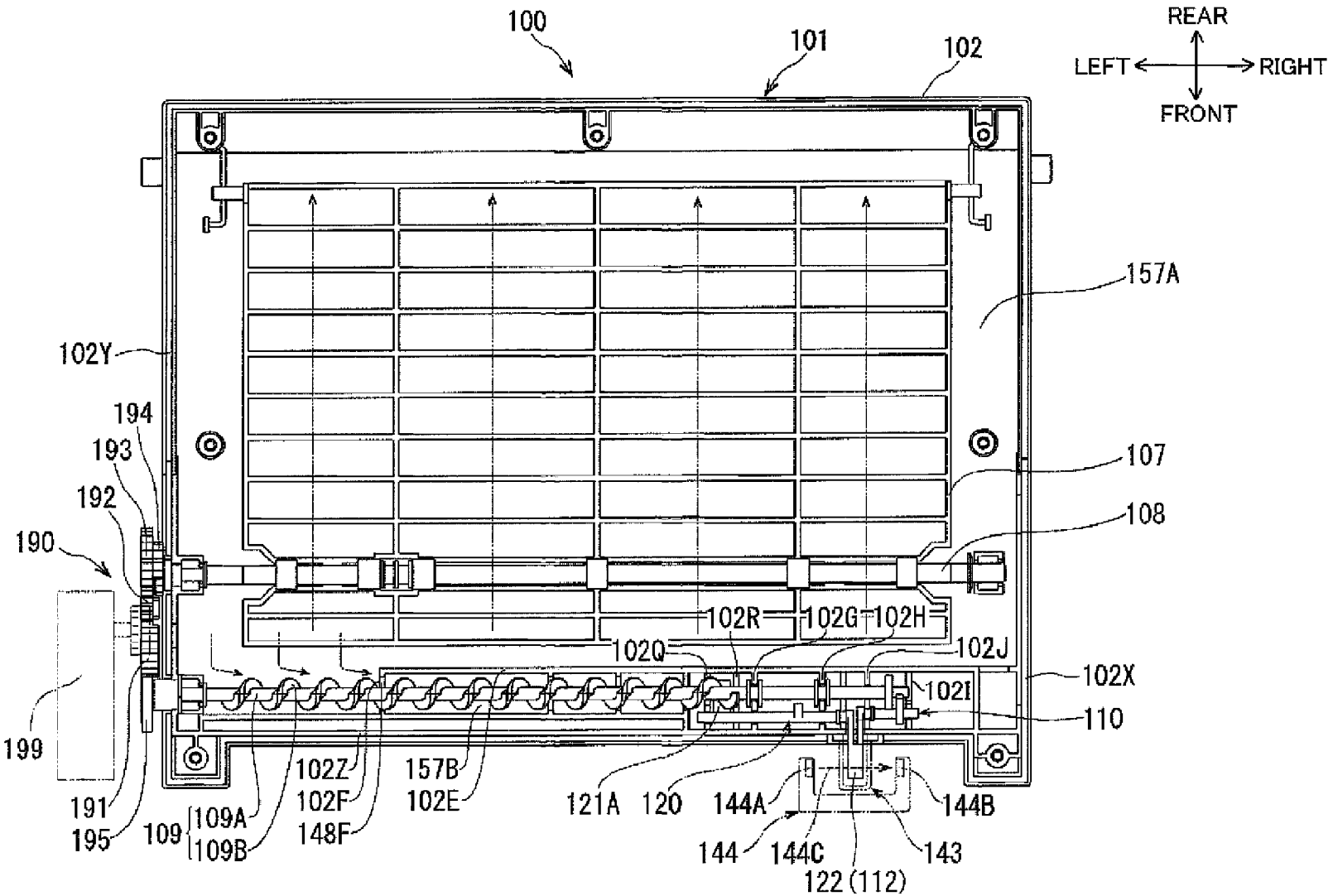
FIG. 4 is a top view of the waste toner collection unit according to the first embodiment of the present invention, in which the front upper cover, a rear upper cover, the cleaning roller and the scraping roller are removed.

As shown in FIG. 4, when the waste toner collection unit 100 is mounted on the frame member, the power transmission mechanism 190 is engaged with a driving source 199 (a motor, for example) provided on the frame member. Upon receipt of driving force from the driving source 199, the gears 191 and 192 start to rotate, transmitting the driving force to the cleaning roller 105 and the scraping roller 106. At this time, as shown by an arrow in FIG. 1, the cleaning roller 105 rotates in a direction opposite to a direction in which the conveyor belt 33 circulates. In other wards, in FIG. 1, the cleaning roller 105 rotates in a counterclockwise direction and a lower section of the conveying belt 33 moves forward. The cleaning roller 105 scrapes and attracts thereto the waste toner deposited on the surface of the conveyor belt 33, thereby cleaning the conveyor belt 33. The scraping roller 106 is charged with a polarity opposite to that of the waste toner (i.e., negative in the first embodiment), and electrically adsorbs the waste toner on the surface of the cleaning roller 105 while the scraping roller 106 rotates and contacts the cleaning roller 105. The separation blade 106A then separates the waste toner away from the surface of the scraping roller 106, and drops the waste toner into the waste toner container 101.

As shown in FIGS. 4 and 5, the container main body 102 includes a front side wall 102Z, a right side wall 102X and a left side wall 102Y. The container main body 102 further includes a partition wall 102E positioned at the rear side of the front side wall 102Z. The partition wall 102E extends from the right side wall 102X toward the left side wall 102Y in the left-to-right direction. The partition wall 102E, however, does not actually reach the left side wall 102Y but ends before reaching the left side wall 102Y. A partition wall 102F is provided at a left end of the partition wall 102E and extends in the front-to-rear direction so as to connect the partition wall 102E and the front side wall 102Z. The partition wall 102F is formed with a recess 148F of a semicircular shape at an upper peripheral end thereof.

Figure 6:
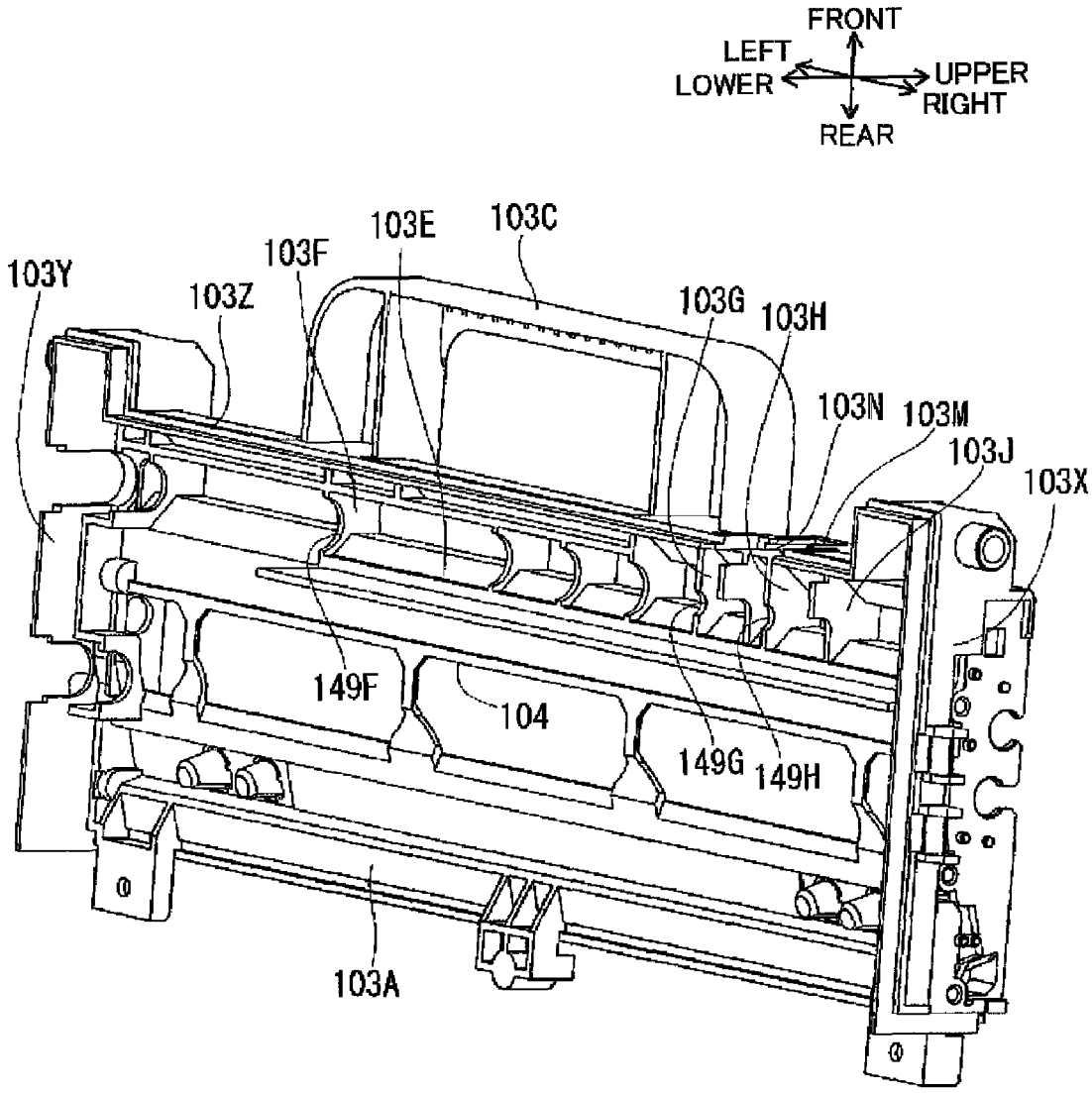
FIG. 6 is a perspective view of the front upper cover according to the first embodiment of the present invention.

As shown in FIG. 6, on the other hand, the front upper cover 103A includes a front side wall 103Z, a right side wall 103X and a left side wall 103Y. The front upper cover 103A is provided with a partition wall 103E positioned at the rear side of the front side wall 103Z. The partition wall 103E extends from the right side wall 103X in the left-to-right direction toward the left side wall 103Y but ends before the left side wall 103Y. A partition wall 103F is provided at a left end of the partition wall 103E. The partition wall 103F extends in the front-to-rear direction and connects the front side wall 103Z and the partition wall 103E. The partition wall 103F is formed with a recess 149F at a bottom peripheral end thereof. The recess 149F has a semicircular shape.

Although not shown, when the front upper cover 103A is assembled to the container main body 102, the partition wall 102E and partition wall 102F are coupled to the partition wall 103E and the partition wall 103F respectively, thereby partitioning the interior of the waste toner container 101 in the front-to-rear direction as well as in the left-to-right direction.

As shown in FIGS. 3 and 4, of the interior of the waste toner container 101, a large space rearward of the partition walls 102E and 103E serves as a waste toner accommodation space 157A. On the other hand, a small space forward of the partition walls 102E and 103E in the interior of the waste toner container 101, which is elongated in the left-to-right direction, serves as a detection space 157B used for detecting an amount of the waste toner accumulated therein. The waste toner accommodation space 157A and the detection space 157B are in communication with each other via a hole that is formed by coupling the recess 148F and the recess 149F.

In the waste toner accommodation space 157A, a grid-like member 107 and a crank shaft 108 are disposed on the container main body 102, as shown in FIG. 4. The crank shaft 108 extends in the left-to-right direction and is rotatably supported on the container main body 102. The grid-like member 107 is connected to the crank shaft 108 at a front end portion thereof.

The crank shaft 108 has a left end connected to the gear 194 of the power transmission mechanism 190, thereby enabling the crank shaft 108 to rotate about a rotational axis thereof in conjunction with the rotation of the gear 194. When the driving force of the driving source 199 is input to the power transmission mechanism 190, the gear 194 starts to rotate. At this time, the driving force of the driving source 199 is transmitted to the crank shaft 108 via the gear 194, thereby rotating the crank shaft 108. Rotation of the crank shaft 108 in turn moves the grid-like member 107 periodically in the front-to-rear direction.

The waste toner scraped away from the scraping roller 106 by the separation blade 106A, firstly, falls onto a front portion of the waste toner accommodation space 157A, and is then conveyed rearward within the waste toner accommodation space 157A with the periodically movement of the grid-like member 107. The waste toner then reaches the rear end of the waste toner accommodation space 157A, whereby the waste toner stops and starts to accumulate. As the waste toner further accumulates little by little, the waste toner gradually occupies the front portion of the waste toner accommodation space 157A. When the waste toner accommodation space 157A becomes full with the waste toner, the waste toner then starts to flow into the detection space 157B via the hole formed by the recess 148F and the recess 149F.

Within the detection space 157B, a conveying screw 109 is disposed in the left-to-right direction. The conveying screw 109 includes a rotational shaft 109A and a blade member 109B. The rotational shaft 109A extends in the left-to-right direction and the blade member 109B is formed on the rotational shaft 109A so as to form a spiral around the rotational shaft 109A. The conveying screw 109 penetrates the hole (the recess 148F and the recess 149F) and extends in the waste toner accommodation space 157A as well.

The rotational shaft 109A has a left end connected to the gear 195 of the power transmission mechanism 190 so as to be capable of rotate synchronously with the rotation of the gear 195, as shown in FIGS. 3 and 4. Therefore, upon receiving the driving force from the driving source 199 to the power transmission mechanism 190, the rotational shaft 109A starts to rotate in response to the rotation of the gear 195. As the conveying screw 109 rotates about the rotational shaft 109A, the blade member 109B conveys the waste toner thereon from the left side to the right side within the detection space 157B. In this way, the waste toner, which can no longer be accommodated in the waste toner accommodation space 157A, is conveyed to the detection space 157B via the hole (the recess 148F and the recess 149F), and is accumulated within the detection space 157B while being conveyed from the left side to the right side therein.

As shown in FIG. 5, within the detection space 157B in the container main body 102, partition walls 102G and 102H, and bearing walls 102J and 102I are provided. The partition walls 102G and 102H and the bearing walls 102J and 102I are disposed at positions rightward of the partition wall 102F within the detection space 157B. The partition walls 102G and 102H and the bearing walls 102J and 102I extend in the front-to-rear direction so as to each connect the partition wall 102E and the front side wall 102Z. The partition walls 102G and 102H and the bearing wall 102J are, at upper peripheral portion thereof, formed with a semicircular recess 148G, 148H and 148J, respectively.

Likewise, as shown in FIG. 6, within the detection space 157B of the front upper cover 103A, partition walls 103G and 103H, and a bearing wall 103J are provided. The partition walls 103G and 103H and the bearing wall 103J are respectively disposed at positions rightward of the partition wall 103E within the detection space 157B. The partition walls 103G and 103H, and the bearing wall 103J extend in the front-to-rear direction to each connect the partition wall 103E and the front side wall 103Z. The partition walls 103G and 103H are, at upper peripheral portion thereof, formed with a semicircular recess 149G and 149H, respectively.

Figure 7:
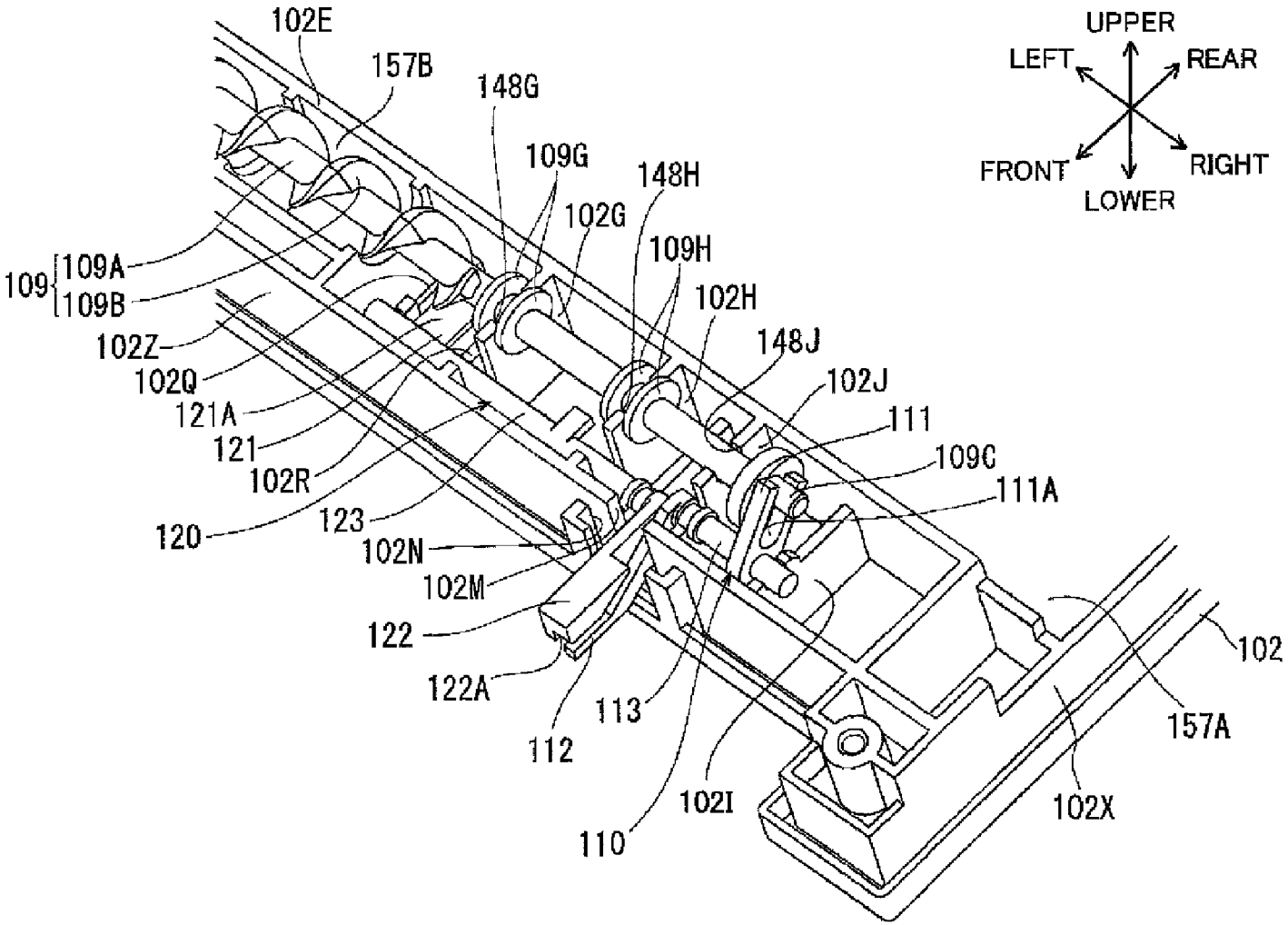
FIG. 7 is an enlarged perspective view of an essential portion of the waste toner collection unit according to the first embodiment of the present invention, in which a conveying screw, a first moving member and a second moving member are shown.

When the front upper cover 103A is assembled to the container main body 102, the partition walls 102G and 102H are coupled to the partition walls 103G and respectively, thereby dividing the interior of the detection space 157B into a plurality of compartments in the left-to-right direction. At this time, the recess 148G and the recess 149G are coupled to form a hole, while the recess 148H and the recess 149H are coupled to form another hole. As shown in FIG. 7 in which the front upper cover 103A is not shown, the rotational shaft 109A penetrates through these two holes with forming a gap between the rotational shaft 109A and the partition walls 102G, 102H, 103G, and 103H. The blade member 109B is so formed on the rotational shaft 109A as to extend close to the partition wall 102G, 103G. That is, the blade member 109B has a right end that is spaced away from the partition wall 102G, 103G.

The rotational shaft 109A is also provided with a pair of flange sections 109G and another pair of flange sections 109H, as shown in FIG. 7. The pair of flange sections 109G interposes the hole formed by the recess 148G and the recess 149G therebetween in the left-to-right direction. Similarly, the another pair of flange sections 109H interposes the hole formed by the recess 148H and the recess 149H therebetween in the left-to-right direction.

When the front upper cover 103A is assembled to the container main body 102, the bearing wall 102J and the bearing wall 103J are coupled to form a recess 148J. The recess 148J serves as a bearing for rotatably supporting the rotational shaft 109A, more precisely, right end portion of the rotational shaft 109A, as shown in FIG. 7.

The right end portion of the rotational shaft 109A protrudes further rightward from the recess 148J (the bearing wall 102J and the bearing wall 103J), and is formed with an eccentric shaft portion 109C. The eccentric shaft portion 109C has a columnar shape and has a rotational axis extending in a direction parallel to a rotational axis about which the rotational shaft 109A rotates. In other words, the rotational axis of the eccentric shaft portion 109C is not coaxially-arranged the rotational axis of the rotational shaft 109A.

While the conveying screw 109 conveys the waste toner from right side to left side within the detection space 157B, the partition walls 102G and 103G stops the movement of the waste toner. Even if the waste toner tries to go into the gap between the rotational shaft 109A and the hole (the recess 148G and the recess 149G) and to move further rightward of the partition walls 102G and 103G, the pair of flange sections 109G prevents such inflow of the waste toner. Even if the waste toner still goes rightward and beyond the partition walls 102G and 103G, another partition walls 102H and 103H then stop the waste toner. At this time, if the waste toner tries to go further into the gap formed between the rotational shaft 109A and the hole (the recess 148H and the recess 149H) to move further rightward, the pair of flange sections 109H then prevents the rightward movement of the waste toner. If the conveyance of the waste toner is completely blocked by the partitioning walls 102G, 103G and 102H and 103H, since the waste toner can go nowhere, the waste toner may damage the conveying screw 109. Therefore, in the first embodiment, the gaps of an appropriate size are formed between the rotational shaft 109A and each of the partition walls 102G, 103G and 102H and 103H, so that the excessive waste toner is allowed to move from one compartment to another. The flange sections 109G and 109H can also serve to prevent backlash of the conveying screw 109 in the left-to-right direction, as well as to support reaction force applied to the conveying screw 109 from the conveyed waste toner.

As shown in FIG. 7, a first moving member 110 and a second moving member 120 are provided adjacent to the right end portion of the rotational shaft 109A within the detection space 157B.

Figure 8:
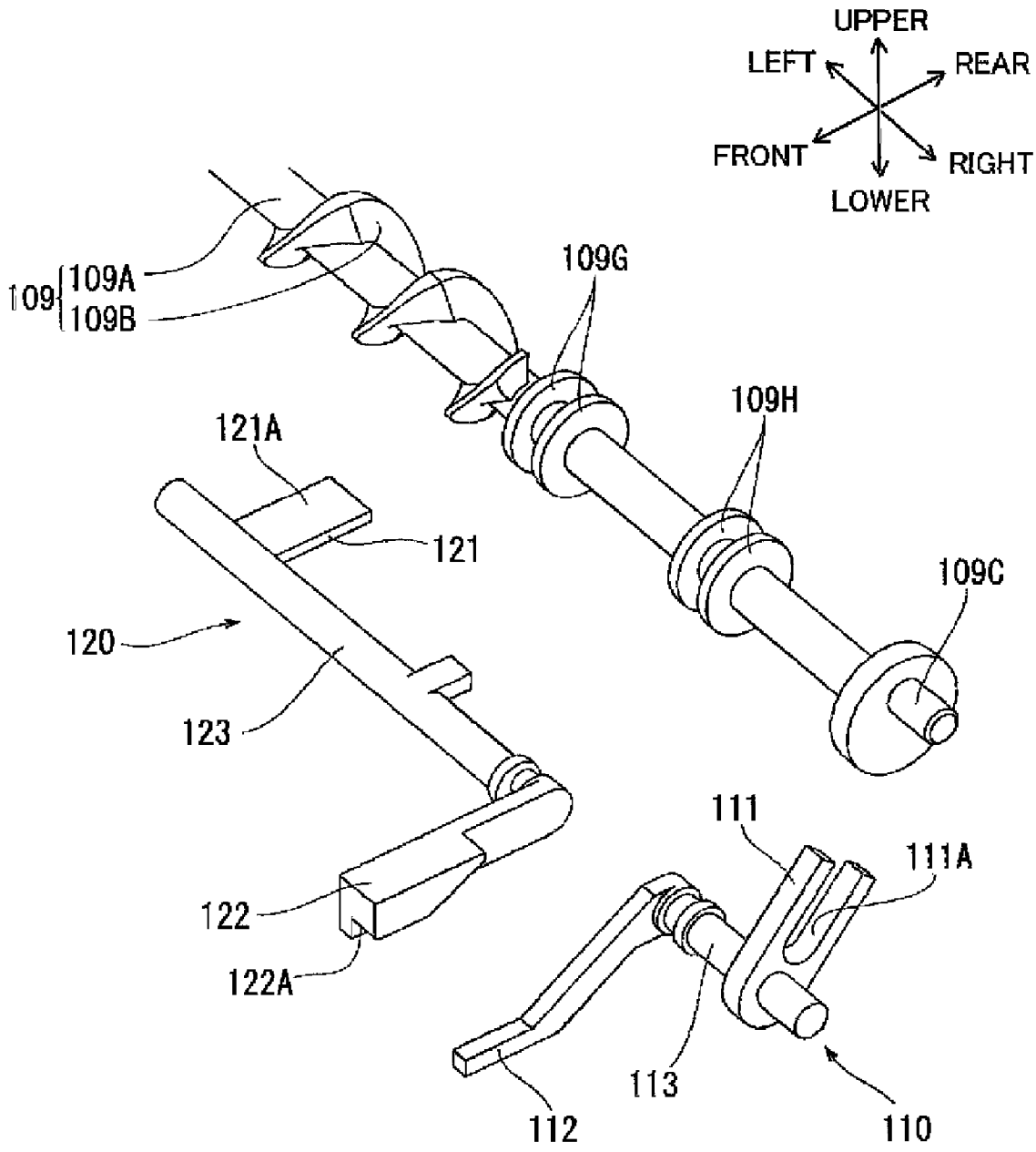
FIG. 8 is a perspective view in which the conveying screw, the first moving member and the second moving member according to the first embodiment are shown separately.

As shown in FIGS. 7 and 8, the first moving member 110 includes a first connecting section 113, a first receiving section 111 and a first shielding section 112. The first connecting section 113 is formed in a columnar shaft shape. The first connecting section 113 has a rotational axis extending in a direction parallel to the rotational axis of the rotational shaft 109A. The first connecting section 113 is rotatably supported by the bearing walls 102J and 102I. The first receiving section 111 extends from the right side portion of the first connecting section 113 in a radial direction of the first connecting section 113. The first receiving section 111 is formed with a slit 111A, having a substantially U shape. As shown in FIG. 7, the first receiving section 111 is assembled to the conveying screw 109 such that the slit 111A receives the eccentric shaft portion 109C of the rotational shaft 109A. The first shielding section 112 has a prismatic column shape, protruding from the left end of the first connecting section 113 outward in the radial direction of the first connecting section 113. The first shielding section 112, however, extends in a direction opposite to the direction in which the first receiving section 111 extends (i.e., forward).

Figure 9:
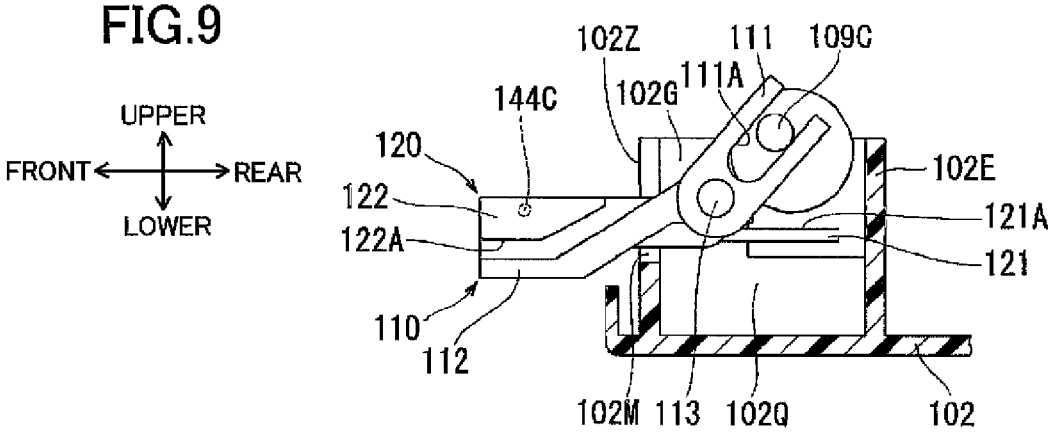
FIGS. 9 and 10 are enlarged cross-sectional views of an essential portion of the waste toner collection unit according to the first embodiment of the present invention explaining how the first moving member and the second moving member move in accordance with rotation of the conveying screw.
Figure 10:
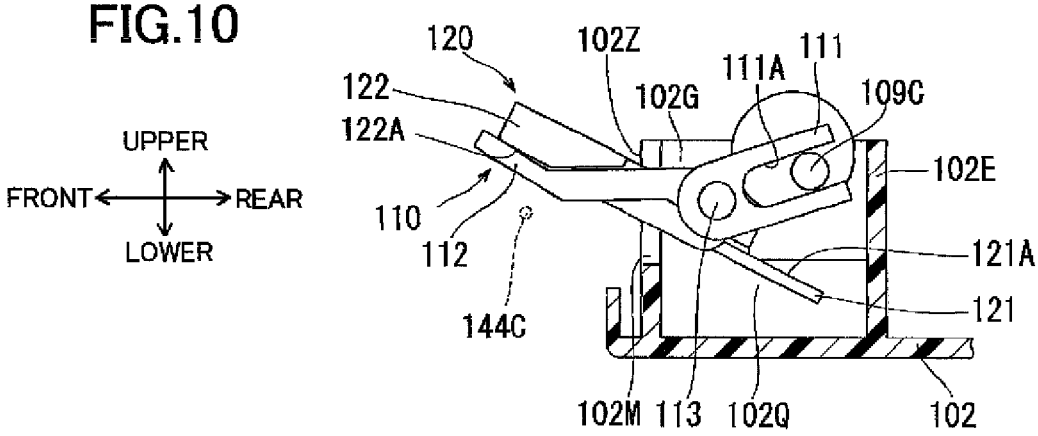

As shown in FIGS. 5 and 7, the front side wall 102Z of the container main body 102 and the front side wail 103Z of the front upper cover 103A are formed with cutout portions 102M and 103M, respectively, in order to allow the first shielding section 112 to protrude outside (forward) from the front side wall 102Z and the front side wall 103Z. As shown in FIGS. 9 and 10, as the eccentric shaft portion 109C makes an eccentric rotation in accordance with the rotation of the conveying screw 109, the first receiving section 111, which is in engagement with the eccentric shaft portion 109C, and the first connecting section 113 enable the first shielding section 112 to pivotally move about the first connecting section 113 in a up-to-down direction.

The second moving member 120 includes a second connecting section 123, a second receiving section 121 and a second shielding section 122, as shown in FIGS. 7 and 8. The second connecting section 123 has a columnar shaft shape. The second connecting section 123 has a rotational ails extending in a direction parallel to the rotational axis of the rotational shaft 109A, just like the first connecting section 113. The second connecting section 123 is rotatably supported by the partition walls 102G and 102H. As shown in FIG. 7, however, the rotational axis of the second connecting section 123 is positioned slightly forward of the rotational axis of the first connecting section 113 in the front-to-rear direction. The second connecting section 123 has a right end in opposition to the left end of the first connecting section 113. The second connecting section 123 extends leftward, beyond the partition wall 102G (and 103G), over to reach the right end of the blade section 109B.

The second receiving section 121 has a plate shape, protruding from the left side portion of the second connecting section 123. The second receiving section 121 extends outward, more specifically rearward, in a radial direction of the second connecting section 123. The second receiving section 121 has a receiving surface 121A facing upward. As shown in FIG. 7, the receiving surface 121A is assembled to the position below the right end of the blade section 109B. As shown in FIGS. 4 and 7, the container main body 102 has a bottom surface from which restriction walls 102Q and 102R erect so as to interpose the receiving surface 121A (the second receiving section 121) therebetween in the left-to-right direction. The restriction walls 102Q and 102R serve to restrict the waste toner W accumulated on the receiving surface 121A from flowing around the second receiving section 121.

The second shielding section 122 has a prismatic column shape, protruding from the right end of the second connecting section 123 outward in the radial direction of the second connecting section 123, more specifically, in a direction opposite to the direction in which the second receiving section 121 extends (i.e., forward).

As shown in FIG. 7, just like the first shielding section 112, the second shielding section 122 protrudes forward from the front side wall 102Z and the front side wall 103Z via the cutout portions 102M and 103M. As shown in FIGS. 7 and 8, the second shielding section 122 is formed with a notch portion 122A. The notch portion 122A is formed as a cutout from the second shielding section 122. The notch portion 122A has a substantially rectangular cross-section and extends in the front-to-rear direction. The notch portion 122A is formed by cutting the lower right portion of the second shielding section 122. The second shielding section 122 is located above the first shielding section 112. When the second shielding section 122 is in contact with the first shielding section 112, the first shielding section 112 is completely accommodated within the notch portion 122A. As shown in FIG. 4, even when seen from above, the first shielding section 112 is covered by the second shielding section 122 in the left-to-right direction as well. That is, the width of the second shielding section 122 in the vertical direction is longer than that of the first shielding section 112.

The second shielding section 122 has a weight heavier than that of the second receiving section 121. Hence, when no external force is applied to the second moving member 120, the second shielding section 122 moves downward relative to the second receiving section 121. However, due to a stopper (not shown), the second moving member 120 maintains a state shown in FIG. 11. At this time, the second receiving section 121 and the second shielding section 122 are both kept horizontally.

Figure 12:
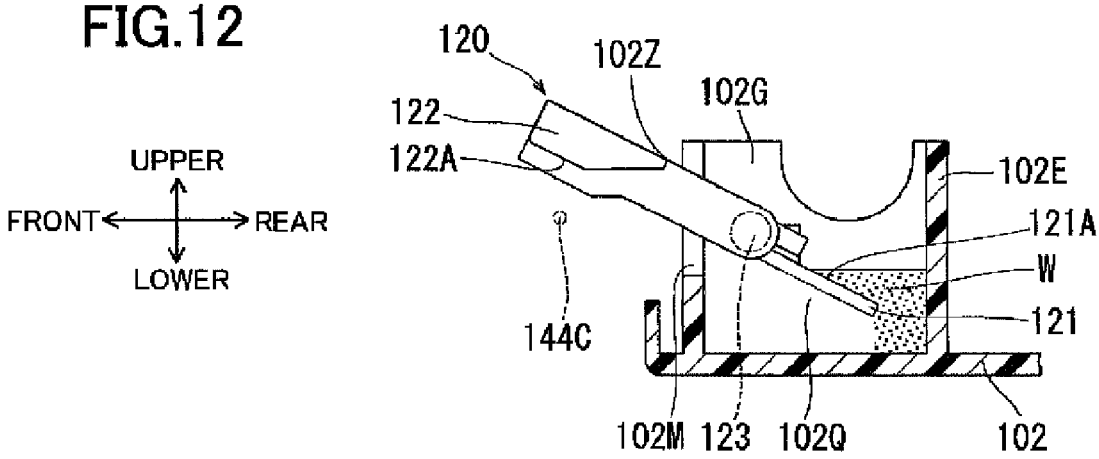
Figure 13:
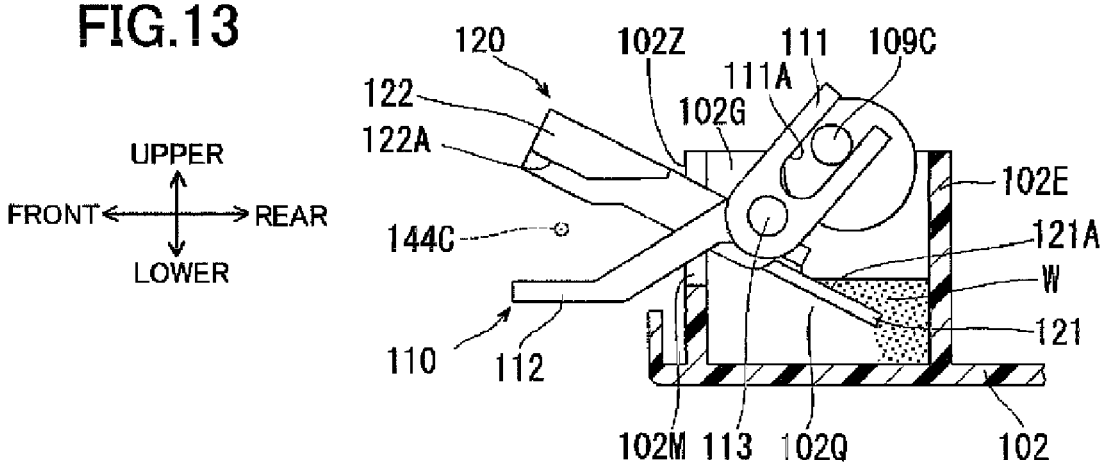
FIG. 13 is an enlarged cross-sectional view of an essential portion of the waste toner collection unit according to the first embodiment of the present invention, explaining how the first moving member and the second moving member move in accordance with rotation of the conveying screw and accumulation of toner.

On the other hand, as the waste toner (designated as W in FIGS. 12 and 13) is accumulated on the receiving surface 121A, the balance between the second receiving section 121 and the second shielding section 122 is lost due to the weight of the waste toner W and the resistance of the waste toner W, making the second receiving section 121 to move downward relative to the second shielding section 122. As a result, the second receiving section 121 is maintained at a position lower than that of the second shielding section 122 as shown in FIG. 12. At this time, when the eccentric shaft portion 109C rotates eccentrically, the first shielding section 112 alone makes a pivotal movement in the up-to-down direction, as shown in FIG. 13.

When the waste toner collection unit 100 is mounted on the frame member, the first shielding section 112 and the second shielding section 122 protrude toward an optical sensor 144 which is provided on the frame member, as shown in FIG. 4. The optical sensor 144 has a well-known structure and includes a light emitting section 144A and a light receiving section 144B disposed in opposition to the light emitting section 144A in the left-to-right direction. The light emitting section 144A is located at a position leftward of the first shielding section 112 and the second shielding section 122, while the light receiving section 144B is located at a position rightward of the first shielding section 112 and the second shielding section 122. A light path 144C is formed between the light emitting section 144A and the light receiving section 144B. The optical sensor 144 detects whether the light path 144C is blocked or not. In accordance with the motion of the first shielding section 112 and the second shielding section 122 as shown in FIGS. 9 through 13, the light path 144C may be either blocked or not blocked by the first shielding section 112 and the second shielding section 122.

As shown in FIGS. 2 and 4, a cover 143 is provided on the front side wall 102Z and the front side wall 103Z for covering the first shielding section 112 and the second shielding section 122. The cover 143 is formed of a transparent resin material so as not to block the light path 144C. The cover 143 is formed with a flange section 143A surrounding the periphery of the cover 143, as shown in FIG. 5. Groove portions 102N and 103N are provided on the front side walls 102Z and 103Z surrounding the cutout portions 102M and 103M. The flange section 143A of the cover 143 is configured to be engaged with the groove portions 102N and 103N. With this simple structure, the cover 143 is fixed to the waste toner container 101. Therefore, the assembly can be simplified, and production costs can be suppressed lower.

8. Electric Configuration of Printer

Next, an electric configuration of the printer 1 will be described with reference to FIGS. 14 and 15.

Figure 14:
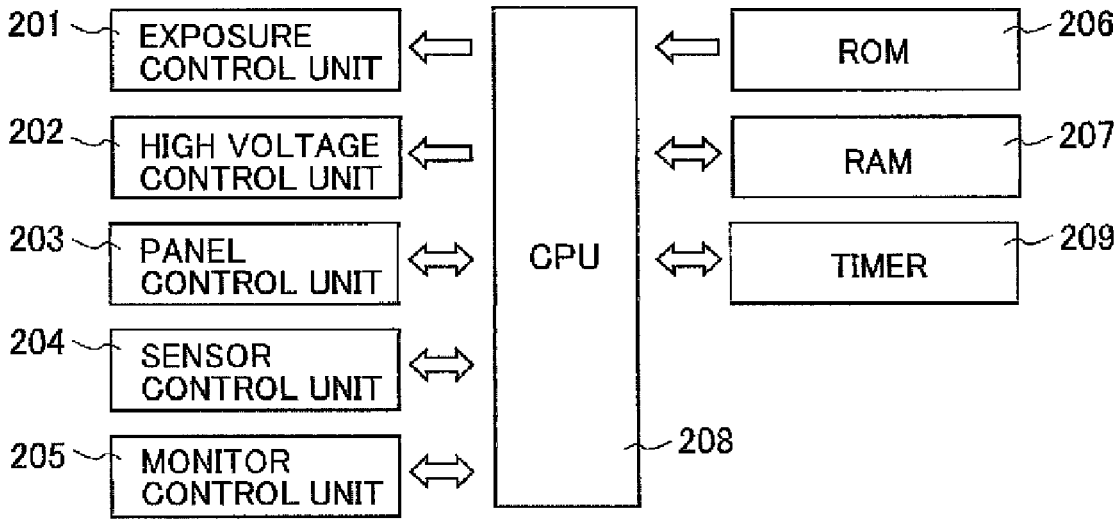
FIG. 14 is a block diagram showing control system of the printer according to the first embodiment of the present invention.

As shown in FIG. 14, the printer 1 includes an exposure control unit 201, a high voltage control unit 202, a panel control unit 203, a sensor control unit 204, a motor control unit 205, a ROM 206, a RAM 207, a CPU 208 and a timer 209.

The exposure control unit 201 controls operations of the scanner unit 60. The high voltage control unit 202 controls operations of the process cartridges 70K-70C, that is, controls high voltages applied to the photosensitive drums 71 during image formation. The panel control unit 203 controls an operation panel (not shown) which the user manipulates for set-up. The sensor control unit 204 controls the light emitting section 144A and the light receiving section 144B of the optical sensor 144. The motor control unit 205 controls the driving source 199 (motor) provided in the printer 1. The ROM 206 stores programs and the RAM 207 stores various information. The CPU 208 executes operations (calculation) based on the programs stored in the ROM 206 in order to control operations of the connected control units. The timer 209 serves as a timekeeper and outputs a signal indicating a time.

Figure 15:
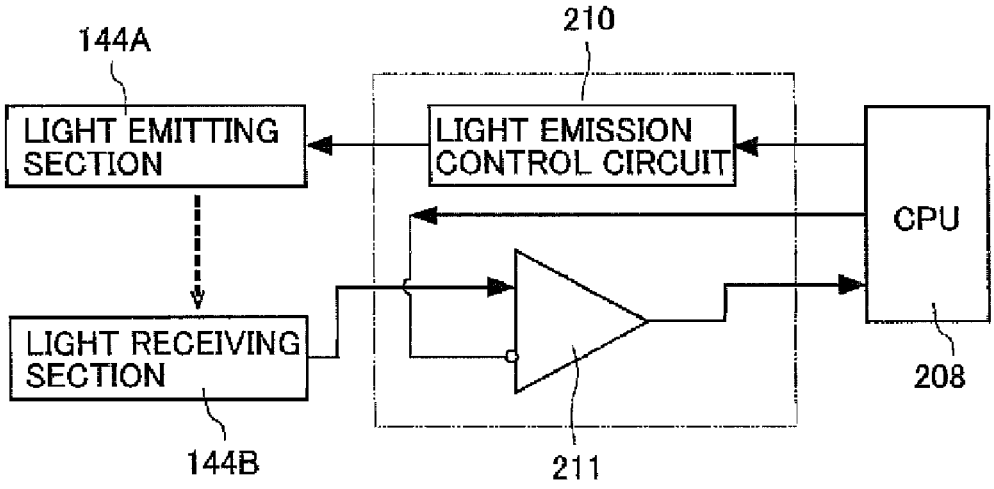
FIG. 15 is a block diagram showing an overview of a sensor control unit in the printer according to the first embodiment of the present invention.

As shown in FIG. 15, the sensor control unit 204 includes a light emission control circuit 210 and a comparator 211. The light emission control circuit 210 controls light emitting operations performed at the light emitting section 144A. The comparator 211 decides whether a signal level output from the light receiving section 144B upon receipt of light from the light emitting section 144A is beyond a predetermined reference level. If the signal level exceeds the reference level, the comparator 211 outputs a 'Low' signal to the CPU 208. To the contrary, if the signal level is lower than the reference level, the comparator 211 outputs a 'Hi' signal to the CPU 208. As described above, since the first shielding section 112 and the second shielding section 122 are configured to either block or release the light path 144C, signal waveform output from the comparator 211, i.e., the detection results of the optical sensor 144, corresponds to the combinations of the movements of the first shielding section 112 and the second shielding section 122. That is, the detection results of the optical sensor 144 changes depending on the movements of the first shielding section 112 and the second shielding section 122.

9. Operations of First Moving Member, Second Moving Member and Optical Sensor

Next, operations of the first moving member 110 and the second moving member 120 are described in association with the output signal of the comparator 211 with reference to FIGS. 9 through 19.

When the printer 1 has been powered and starts warming up, or when the printer 1 has switched to an operating state from a stand-by state, the sensor control unit 204 starts controlling the optical sensor 144. At the same time, the CPU 208 starts executing a determination program shown in FIG. 20, as will be described later. The motor control unit 205 starts to control the driving source 199. In response, the driving force of the driving source 199 is transmitted to the conveyor belt 33, enabling the conveyor belt 33 to start circulating. Also, upon receipt of the driving force from the power transmission mechanism 190, the cleaning roller 105, scraping roller 106, crank shaft 108 and conveying screw 109 start to rotate and the grid-like member 107 starts to move in response to the rotation of the crank shaft 108. As a result, the waste toner deposited on the conveyor belt 33 is first accumulated in the waste toner accommodation space 157A, and then conveyed to the detection space 157B via the hole (the recess 148F and the 149F) by the conveying screw 109. Hereinafter, the cleaning roller 105, the scraping roller 106, the crank shaft 108, the grid-like member 107 and the conveying screw 109 are collectively referred to as 'waste toner conveying unit.'

At this time, as shown in FIGS. 9, 10 and 13, as the conveying screw 109 rotates, the eccentric shaft portion 109C eccentrically rotates, thereby pivotally moving the first receiving section 111 which is in engagement with the eccentric shaft portion 109C. In accordance with the pivotal movement of the first receiving section 111, the first shielding section 112 starts to pivotally move in the up-to-down direction via the first connecting section 113. As a result, the first shielding section 112 may come to a blocking position at which the first shielding section 112 blocks the light path 144C (although not shown, an intermediate position between a lowermost position as shown in FIGS. 9 and 13, and an uppermost position as shown in FIG. 10), or to a releasing position at which the first shielding section 112 does not block the light path 144C (such as positions shown in FIGS. 9, 13 and 10). Here, when the eccentric shaft portion 109C makes one eccentric rotation, the first shielding section 112 makes one pivotal movement in the up-to-down direction (one reciprocating movement). In the meantime, the first shielding section 112 moves between the upper position shown in FIG. 10 and the lower position as shown in FIGS. 9 and 13. In other words, the first shielding section 112 blocks the light path 144C twice while the eccentric shaft portion 109C makes one rotation.

Figure 11:
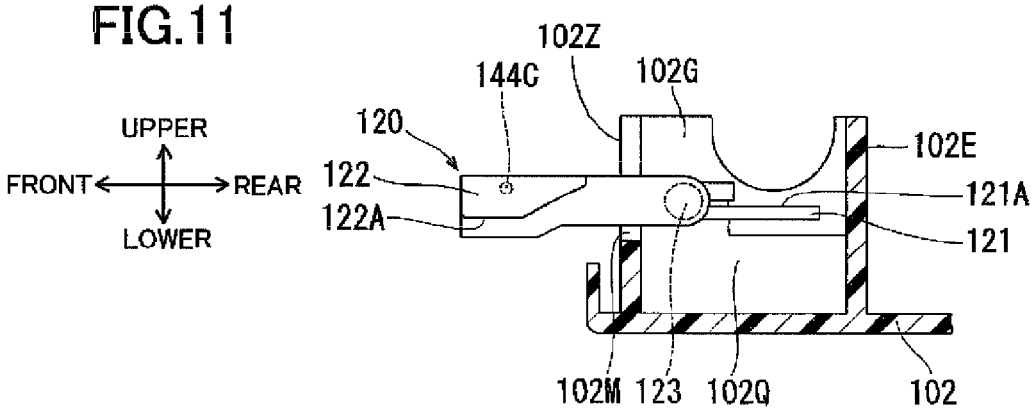
FIGS. 11 and 12 are enlarged cross-sectional views of an essential portion of the waste toner collection unit according to the first embodiment of the present invention, explaining how the second moving member moves in accordance with accumulation of toner.

As shown in FIG. 11, within the detection space 157B, as long as the waste toner W is not accumulated on the receiving surface 121A, the movement of the second receiving section 121 in the up-to-down direction is not controlled by the waste toner W. Hence, the second shielding section 122, which is integrally formed with the second receiving section 121, is pushed upward when the first shielding section 112 contacts the second shielding section 122 from below, and since the first shielding section 112 periodically pivots in the up-to-down direction, the second shielding section 122 also pivots in the up-to-down direction in conjunction with the pivotal movement of the first shielding section 112. The second shielding section 122, therefore, come to a blocking position at which the second shielding section 122 blocks the light path 144C (a lowermost position as shown in FIGS. 9 and 11) and to a releasing position at which the second shielding section 122 does not block the light path 144C (an uppermost position as shown in FIGS. 10 and 12). In other words, the second shielding section 122 blocks the light path 144C once while the eccentric shaft portion 109C makes one rotation.

Figure 16:
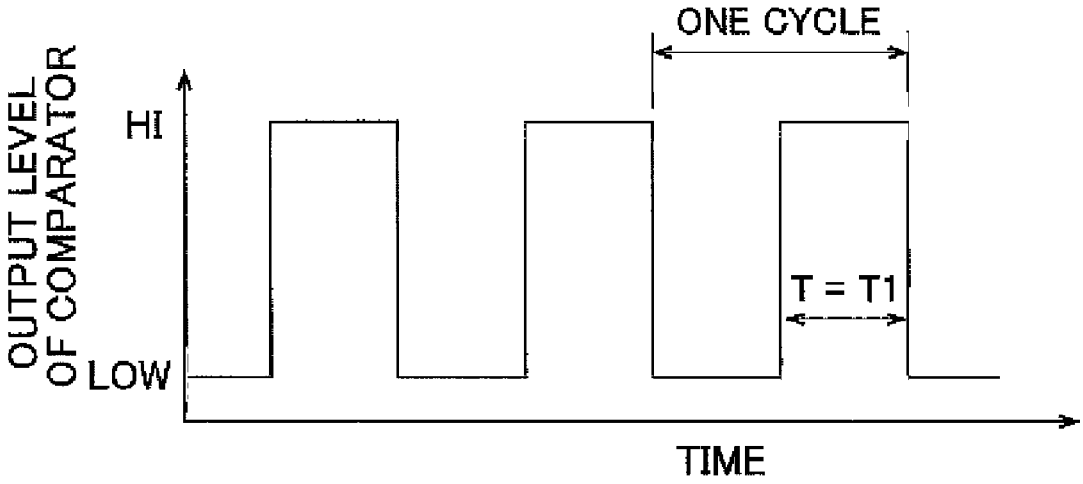
FIGS. 16 to 19 are graphs each illustrating an example of detection results made by the sensor control unit according to the first embodiment of the present invention (a relationship between time and output signals from the sensor control unit)

In this way, when the waste toner W is not accumulated on the receiving surface 121A, the first shielding section 112 and the second shielding section 122 work in cooperation with each other to pivotally move in the up-to-down direction, thereby blocking the light path 144C on a periodic basis. At this time, in response to the output signal from the optical sensor 144, the comparator 211 outputs a signal waveform as shown in FIG. 16. The signal waveform in this case cyclically alternates between 'Hi' and 'Low.' One cycle length corresponds to a period during which the eccentric shaft portion 109C makes one rotation. A single duration time T during which the waveform indicative of 'Hi' is continued per one cycle in the signal waveform is equal to a period T1 which is a single period of time required for the first shielding section 112 and the second shielding section 122 (in contact with each other) to block the light path 144C for one time.

Then, when the waste toner W is accumulated on the receiving surface 121A as shown in FIG. 12, the balance between the second receiving section 121 and the second shielding section 122 changes due to the weight of the waste toner W and the resistance of the waste toner W. As a result, the second receiving section 121 is held at the lower position than that of the second shielding section 122, while the second shielding section 122 is held at a position upward of and in separation from the first shielding section 112, thereby not blocking the light path 144C. The first shielding section 112, alone, continues to pivotally move in the up-to-down direction in accordance with the rotation of the eccentric shaft portion 109C, as shown in FIG. 13.

Figure 17:
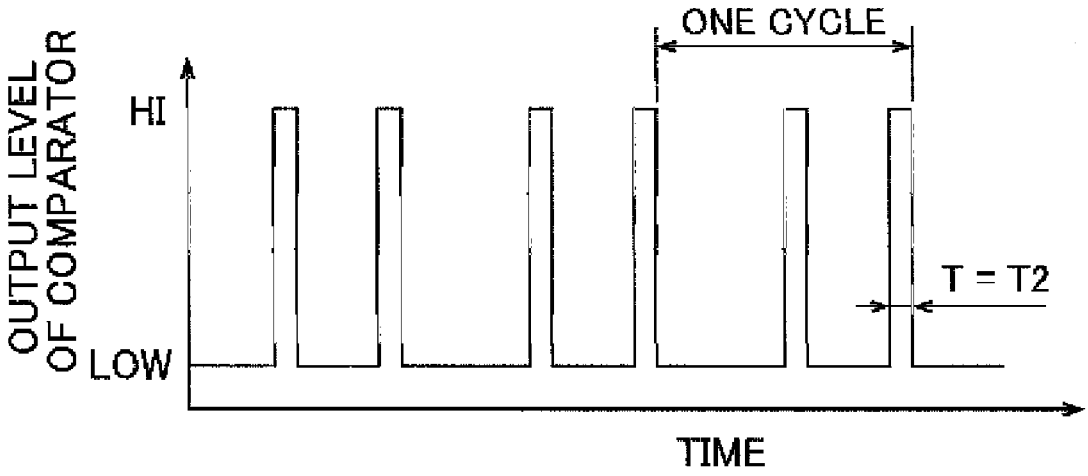

In this way, when the waste toner W has accumulated on the receiving surface 121A, only the first shielding section 112 pivotally moves in the up-to-down direction periodically and blocks the light path 144C on the same interval. At this time, the comparator 211 outputs, in response to the output signal from the optical sensor 144, a signal waveform as shown in FIG. 17. The signal waveform in this case also cyclically alternates between 'Hi' and 'Low.' However, the duration time T during which the 'Hi' waveform is continued per one cycle in the signal waveform is equal to a period T2 which is a period of time required for the first shielding section 112 alone to block the light path 144C for one time. That is, the period T2 is smaller than the period T1. Further, the waveform indicative of 'Hi' appear twice during one cycle since the first shielding section 112 blocks the light path 144C twice while the eccentric shaft portion 109C makes one rotation.

If there is any trouble with the conveying screw 109, or the power transmission mechanism 190 and the driving source 199 located upstream of the conveying screw 109 in a waste toner conveying direction in which the waste toner is conveyed when the optical sensor 144 is in operation, the conveying screw 109 does not rotate, and therefore the eccentric shaft portion 109C does not eccentrically rotate either. In this case, the first receiving section 111, although engaging the eccentric shaft portion 109C, does not pivotally move. Accordingly, the first shielding section 112 and the second shielding section 122 maintain either one of the blocking position and the releasing position. Further, when the printer 1 is activated without the waste toner collection unit 100 being mounted on the housing 3, the light path 144C is not blocked.

Figure 18:
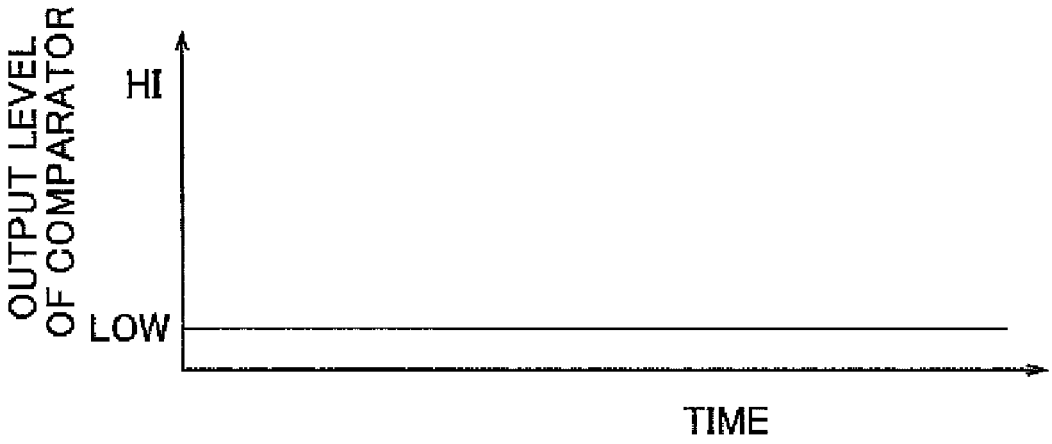
Figure 19:
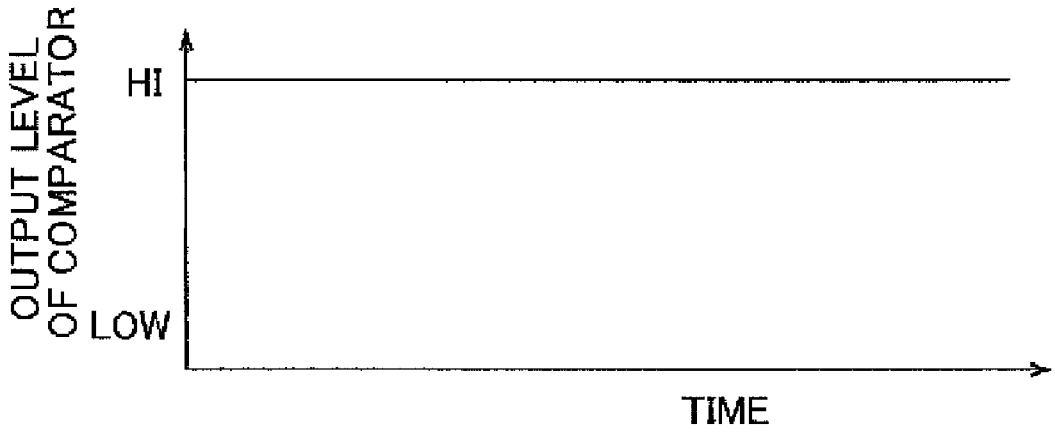

When the first shielding section 112 and the second shielding section 122 remain stationary, or when the waste toner collection unit 100 is removed from the housing 3, in response to the output signal from the optical sensor 144, the comparator 211 outputs, to the CPU 208, a signal waveform which corresponds to either one of those shown in FIGS. 18 and 19. More specifically, the waveform does not change at all but remains unchanged either at a 'Hi' or 'Low' state.

10. Determination Program

Next, the determination program executed by the CPU 208 will be described with reference to FIG. 20. As described earlier, this determination program is configured to be repeated as long as the driving force is supplied to the power transmission mechanism 190 from the driving source 199.

Figure 20:
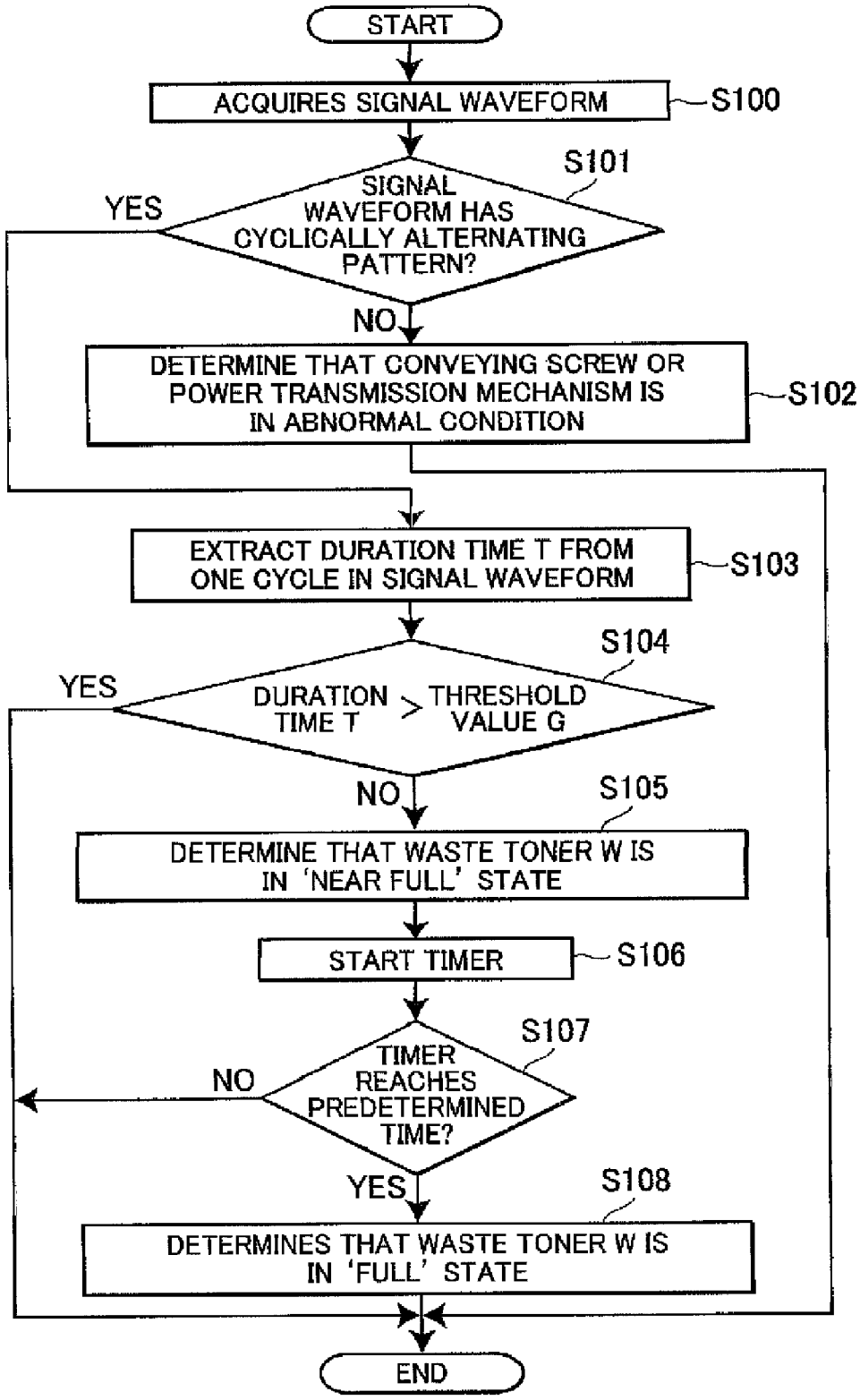
FIG. 20 is a flowchart of a determination program executed by the CPU of the first embodiment of the present invention.

Referring to FIG. 20, in S100, the CPU 208 first acquires the signal waveform output from the comparator 211 based on the output signal from the optical sensor 144. In S101, the CPU 208 determines whether the signal waveform acquired in S100 has a cyclically alternating pattern. If the acquired waveform has a flat pattern as shown in FIGS. 18 and 19 (S101: No), in S102 the CPU 208 determines that the conveying screw 109 or the power transmission mechanism 190 located upstream of the conveying screw 109 is in an abnormal condition and terminates this determination program.

In this case, the CPU 208 may launch a troubleshooting process or warn the user about the failure. In the troubleshooting process, the CPU 208 may assume that any one of the following malfunctions has occurred: the conveying screw 109 is broken or damaged; the power transmission mechanism 190 is broken or damaged; power supply is poor; the waste toner collection unit 100 is not mounted. The printer 1 is configured to stop operating until some prescribed coping is taken in response to the warning.

On the other hand, in S101 if the acquired signal waveform is determined to be cyclically alternating between 'Hi' and 'Low' (S101: Yes), in S103 the CPU 208 then extracts, from the signal waveform, a duration time T indicative of the continuance of 'Hi' signal in one cycle.

Then in S104, the CPU 208 determines whether the duration time T extracted in S103 is greater than a predetermined threshold value G. In the first embodiment, the threshold value G is set to a value substantially intermediate between the period T1 and the period T2 ($T2<G<T1$). If the duration time T is equal to the period T1 as shown in FIG. 16 (S104: Yes), the CPU 208 determines that the waste toner W is not yet accumulated on the receiving surface 121A of the second receiving section 121, terminating the determination program. The CPU 208 then repeats the steps S100-S104 until the waste toner W is accumulated on the receiving surface 121A enough to change the balance between the second receiving section 121 and the second shielding section 122. In the first embodiment, the state where the waste toner W has accumulated on the receiving surface 121A is referred to as 'near full,' meaning that the waste toner W has accumulated up to a state close to a state in which the waste toner collection unit 100 becomes 'full' with the waste toner W.

If the duration time T is equal to the period T2 as shown in FIG. 17 (S104: No), in S105 the CPU 208 determines that the waste toner W in the waste toner container 101 is now 'near full' state. In this case, the CPU 208 notifies the user that the waste toner collection unit 100 will need a replacement soon.

Subsequently, in S106, the CPU 208 controls the timer 209 to start timekeeping in order to determine when the waste toner W in the waste toner container 101 becomes really 'full.' Specifically, the timer 209 keeps time until operation time of the printer 1 reaches a predetermined time after the 'near full' decision has been made in S105.

Then in S107 the CPU 208 once terminates the determination program and repeats the steps from S100 to S107 until the timer 209 reaches the predetermined time (S107: No). With this configuration, even if the waste toner W in the waste toner container 101 is in 'near full' state, the CPU 208 continues to acquire signal waveform from the optical sensor 144, and therefore is able to detect whether the power transmission mechanism 190 and the conveying screw 109 are operating without any problems. Once the CPU 208 determines that the waste toner W in the waste toner container 101 is in 'near full' state in S105 and the timer 209 starts the time keeping in S106, in the subsequent steps from S100 to S107, the CPU 208 skips the process of S105 and S106.

If the timer 209 reaches the predetermined time in S107 (S107: Yes), in S108 the CPU 208 determines that the waste toner W in the waste toner container 101 is in 'full' state, and terminates the program. At this time, the CPU 208 notifies the user that the waste toner collection unit 100 needs to be replaced immediately. In this case as well, the printer 1 stops operating until the user takes appropriate actions in response to the warning.

Effects of First Embodiment

As described above, the printer 1 of the first embodiment includes the waste toner container 101, the power transmission mechanism 190, the waste toner conveying unit including the conveying screw 109, the first moving member 110, the second moving member 120 and optical sensor 144. The printer 1 (the CPU 208) executes the processes shown from S100 to S108 in FIG. 20.

The first moving member 110 includes the first shielding section 112. The first shielding section 112 is configured to either block or release the light path 144C as a result of movement of the first moving member 110 (pivotal movement in the up-to-down direction). The second moving member 120 includes the second shielding section 122. The second shielding section 122 is configured to either block or release the light path 144C by integrally moving with the first shielding section 112, as along as the waste toner W is not yet accumulated on the receiving surface 121A to a certain level. Once the amount of the waste toner W accumulated on the receiving surface 121A has exceeded the certain level, on the other hand, the second shielding section 122 moves to a position where the light path 144C is not blocked, while separating from the first shielding section 112.

With this configuration, the optical sensor 144 outputs detection results that correspond to the combinations of the movements of the first moving member 110 and the second moving member 120. In other words, the optical sensor 144 outputs detection results that changes depending on the movements of the first moving member 110 and the second moving member 120. Hence, by executing the steps S100-108, the CPU 208 can make two types of decisions: whether there is any problem with the conveying screw 109 or power transmission mechanism 190 located upstream of the conveying screw 109; and how much waste toner has been accumulated.

More specifically, if there is nothing wrong with the conveying screw 109 and other components located upstream thereof, the first shielding section 112 and the second shielding section 122 periodically block the light path 144C. Accordingly, the optical sensor 144 outputs a detection result (signal waveform) indicative of periodic change (as shown in FIGS. 16 and 17, for example). If any trouble has occurred in the conveying screw 109 or other components located upstream thereof in the waste toner conveying direction and therefore the conveying screw 109 has stopped, on the other hand, the first shielding section 112 and the second shielding section 122 keep blocking or releasing the light path 144C. The optical sensor 144, therefore, outputs a detection result (signal waveform) indicating no cyclical change (as shown in FIGS. 18 and 19, for example). As a result, the CPU 208 can determine that, by executing the steps S101-102 in FIG. 20, the conveying screw 109 and/or other upstream components in the waste toner conveying direction have some kind of trouble.

Moreover, the second shielding section 122, along with the first shielding section 112, blocks the light path 144C periodically until the waste toner W is accumulated on the receiving surface 121A to the certain level. However, when the waste toner W has accumulated on the receiving surface 121A to reach the certain level, the second shielding section 122 separates from the first shielding section 112 and moves upward to release the light path 144C, while the first shielding section 112 alone continues to cyclically block the light path 144C. Hence, the optical sensor 144 outputs two detection results (two signal waveforms as shown in FIGS. 16 and 17) that each having a cyclical alternation between 'Hi' and 'Low' per one cycle but the duration times T indicative of the 'Hi' signal in the two signal waveforms are different from each other. As a result, the CPU 208 can immediately determine, by executing the steps S103-S105, that the waste toner W in the waste toner container is in 'near full' state. In other words, according to the printer 1 of the first embodiment, one single optical sensor 144 enables the CPU 208 to make two types of decisions, without employing two different detection sensors as in conventional printers.

Hence, according to the printer 1 of the first embodiment, overall confirmation of the printer 1 can be simplified, thereby leading to reduction in the production costs.

Further, the second moving member 120 is further provided with the second receiving section 121 and the second connecting section 123 in addition to the second shielding section 122. The second receiving section 121 has no restriction on the pivotal movement thereof in the up-to-down direction in accordance with the movement of the second shielding section 122, as long as the waste toner W has not yet accumulated on the receiving surface 121A. As long as there is no restriction on the movement of the second receiving section 121, the second shielding section 122 contacts the first shielding section 112 from above due to the self-weight, thereby making pivotal movements in the up-to-down direction integrally with the first shielding section 112. However, once the waste toner W has accumulated enough on the receiving surface 121A, the second receiving section 121 is adapted to pivotally move downward. When the second receiving section 121 is held at a position lower than before, the second shielding section 122 is adapted to separate from the first shielding section 112 and is held at a position upward of and away from the first shielding section 112. In this way, the balance between the second receiving section 121 and the second shielding section 122 is configured to change in response to the waste toner W accumulated on the receiving surface 121A of the second receiving section 121, thereby enabling the printer 1 to have a further simplified configuration.

Further, the second shielding section 122 is formed with the notch portion 122A extending in the front-to-rear direction. The notch portion 122A is formed by cutting the lower right portion of the second shielding section 122. When seen from above, the notch portion 122A can accommodate the entire first shielding section 112 therein. In other words, when accommodated within the notch portion 122A, the first shielding section 112 cannot be seen from above (i.e., the first shielding section 112 does not protrude from the notch portion 122A in the left-to-right direction). Hence, the first shielding section 112 and the second shielding section 122 can have a width relatively short (narrow) in the left-to-right direction, thereby enabling the distance between the light emitting section 144A and the light receiving section 144B to become shorter. As a result, the optical sensor 144 as a whole can be made smaller, allowing the printer 1 to be compact.

The second connecting section 123 extends long, in parallel with the conveying screw 109, in the left-to-right direction. The second receiving section 121 is disposed on the second connecting section 123 at a position upstream in the waste toner conveying direction. The first shielding section 112 and the second shielding section 122 are disposed at a position away from and downward of the second receiving section 121 in the waste toner conveying direction. Hence, even if the waste toner W has accumulated on the second receiving section 121, the waste toner does not easily arrive at the first shielding section 112 and the second shielding section 122, preventing detection accuracy of the optical sensor 144 from being lowered.

Further, between the second receiving section 121 and the second shielding section 122 (and the first shielding section 112), the partition walls 102G, 103G and 102H, 103H are provided for dividing the detection space 157B into one space where the second receiving section 121 is located and another space where the second shielding section 122 and the first shielding section 112 are located. The partition wall 102G, 103G is located closer to the second receiving section 121, while the partition wall 102H and 103H is located closer to the second shielding section 122 (aNd the first shielding section 112). In this way, even if the waste toner W accumulates on the second receiving section 121, both partition walls 102G, 103G and 102H, 103H can reliably prevent the arrival of the waste toner W to the second shielding section 122 and the first shielding section 112), thereby further suppressing deterioration of detection accuracy at the optical sensor 144.

Further, the first shielding section 112 and the second shielding section 122 are respectively formed in such a size that the period T2 (time required for the first shielding section 112 only to block the light path 144C at a time) can be shorter than period T1 (time required for the first shielding section 112 and the second shielding section 122 to integrally block the light path 144C at a time). Hence, the optical sensor 144 can output detection results which allow an easy distinction between the case where the first shielding section 112 and the second shielding section 122 are integrally cyclically moved and the case where only the first shielding section 112 is cyclically moved. In this way, the CPU 208 can make an accurate determination in S104 during the determination program (S100-S108).

Further, the waste toner container 101, the power transmission mechanism 190, the waste toner conveying unit 105-109, the first moving member 110 and the second moving member 120 all constitute the waste toner collection unit 100, which is detachably mounted on the frame member of the housing 3. On the other hand, the optical sensor 144, the CPU 208 and the ROM 206 are provided on the housing 3. With this configuration, even if the waste toner collection unit 100 is removed from the frame member, the CPU 208 can determine that there is something wrong with the conveying screw 109 and other upstream components. Hence, the printer 1 can never operate without the waste toner collection unit 100 being mounted thereon. Further, this configuration ensures that, even if the waste toner collection unit 100 is removed from the frame member, leakage of the waste toner W from the vicinity of the second shielding section 122 can be reliably prevented. In the present embodiment, provision of the cover 143 further promotes prevention of the waste toner leakage.

Further, the second receiving section 121 is configured to cyclically vertically move in response to the movement (a driving force) of the first moving member 110 as long as the waste toner W has not accumulated enough on the receiving surface 121A. However, once the waste toner W has been accumulated on the receiving surface 121A, regardless of the movement of the first moving member 110, the second receiving section 121 is configured to be held at a position lower than otherwise. While the second receiving section 121 is moving periodically in the up-to-down direction, the second shielding section 122 pivotally moves in conjunction with the movement of the second receiving section 121 via the second connecting section 123, blocking the light path 144C periodically. On the other hand, once the second receiving section 121 is held at the lower position thereof, the second shielding section 122 is configured to be held at such a position that the second shielding section 122 does not block the light path 144C.

According to the printer 1 of the above-described configuration, the second receiving section 121, on which the waste toner W accumulates, and the second shielding section 122 that either blocks or releases the light path 144C are disposed to be in separation from each other. Hence, the waste toner W hardly reaches the light emitting section 144A and the light receiving section 144B, preventing the waste toner W from leaking from the waste toner container 101 to the optical sensor 144. The performance of the light emitting section 144A and the light receiving section 144B can be maintained without causing degradation.

Up until the waste toner W is accumulated on the second receiving section 121, the second receiving section 121 is periodically moved in accordance with the movement of the first moving member 110, making the second shielding section 122 cyclically block the light path 144C along with the first shielding section 112. At this time, the optical sensor 144 outputs a detection result (signal waveform) corresponding to the movement of the second shielding section 122, indicating that the second shielding section 122, together with the first shielding section 112, is cyclically blocking the light path 144C (as shown in FIG. 16). On the other hand, once the waste toner W has been accumulated on the second receiving section 121, the second receiving section 121 is held at the lower position and the second shielding section 122 is in turn held at the position where the light path 144C is released in conjunction with the second receiving section 121. At this time, the optical sensor 144 outputs the detection result (signal waveform) corresponding to the released light path 144C by the second shielding section 122 (as shown in FIG. 17). In this way, depending on whether or not the waste toner W has been accumulated on the second receiving section 121, the optical sensor 144 can output detection results different from each other, thereby enabling the CPU 208 to make accurate determinations through the determination program.

Hence, the printer 1 of the present embodiment can determine, with accuracy, whether or not the waste toner W has been accumulated enough to reach a predetermined accumulation level ('near full') within the waste toner container 101.

In the printer 1 of the first embodiment, the first moving member 110 is provided as a member separate from the second moving member 120. The first moving member 110 pivotally moves in the up-to-down direction in conjunction with the movement of the conveying screw 109 constituting the waste toner conveying unit, since the first moving member 110 and the conveying screw 109 are engaged with each other. The second shielding section 122 contacts the vertically moving first shielding section 112 from above, thereby enabling the first shielding section 112 and the second shielding section 122 together to move integrally to cyclically block the light path 144C. The second receiving section 121 is allowed to move in the up-to-down direction in association with the movement of the second shielding section 122 via the second connecting section 123 during a period when the waste toner W is being accumulated on the receiving surface 121A. Once the waste toner W has been accumulated on the receiving surface 121A, on the other hand, the second receiving section 121 is held at the lower position thereof due to the weight of the waste toner W. In response to the second receiving section 121 being held at the lower position, the second shielding section 122 is made to separate from the first shielding section 112, and is maintained at the position upward than otherwise, releasing the light path 144C.

With this configuration, the weight of the waste toner W and the resistance of the waste toner W cause the balance between the second receiving section 121 and the second shielding section 122 to change, easily making the second shielding section 122 release the light path 144C concurrently with cutting off the transmission of the driving force from the first moving member 110 to the second moving member 120. Hence, the printer 1 can have a simplified configuration.

Further, the first moving member 110 and the second moving member 120 are both formed as small members disposed adjacent to the conveying screw 109, also enabling the printer 1 to be made compact.

The flange sections 109G and 109H formed around the rotational shaft 109A of the 109 of the conveying screw 109 serve to appropriately cover the gaps (holes) formed in the partition walls 102G, 103G and 102H, 103H. Hence, the arrival of the waste toner W to the second shielding section 122 can be delayed.

Further, since the second receiving section 121 and the second shielding section 122 are disposed in separation from each other, leakage of the waste toner W in the vicinity of the second shielding section 122 can be suppressed. Hence, the transparent cover 143 for covering the second shielding section 122 can be attached to the waste toner container 101 by simply coupling the peripheral portion of the cover 143 to the grooves 102N and 103N, realizing simplification of the assembly and reduction in production costs.

Further, the restriction walls 102Q and 102R can prevent the waste toner W to be accumulated on the receiving surface 121A from flowing out therefrom, thereby enabling the printer 1 (CPU 208) to determine the accumulation status of the waste toner W with higher accuracy. Although the two restriction walls 102Q and 102R are provided in the first embodiment, the second receiving section 121 may be positioned closer to the partition wall 102G so that the partition wall 102G can also serve as a restriction wall. Therefore, in this case, the restriction wall 102R may be omitted.

Figure 21:
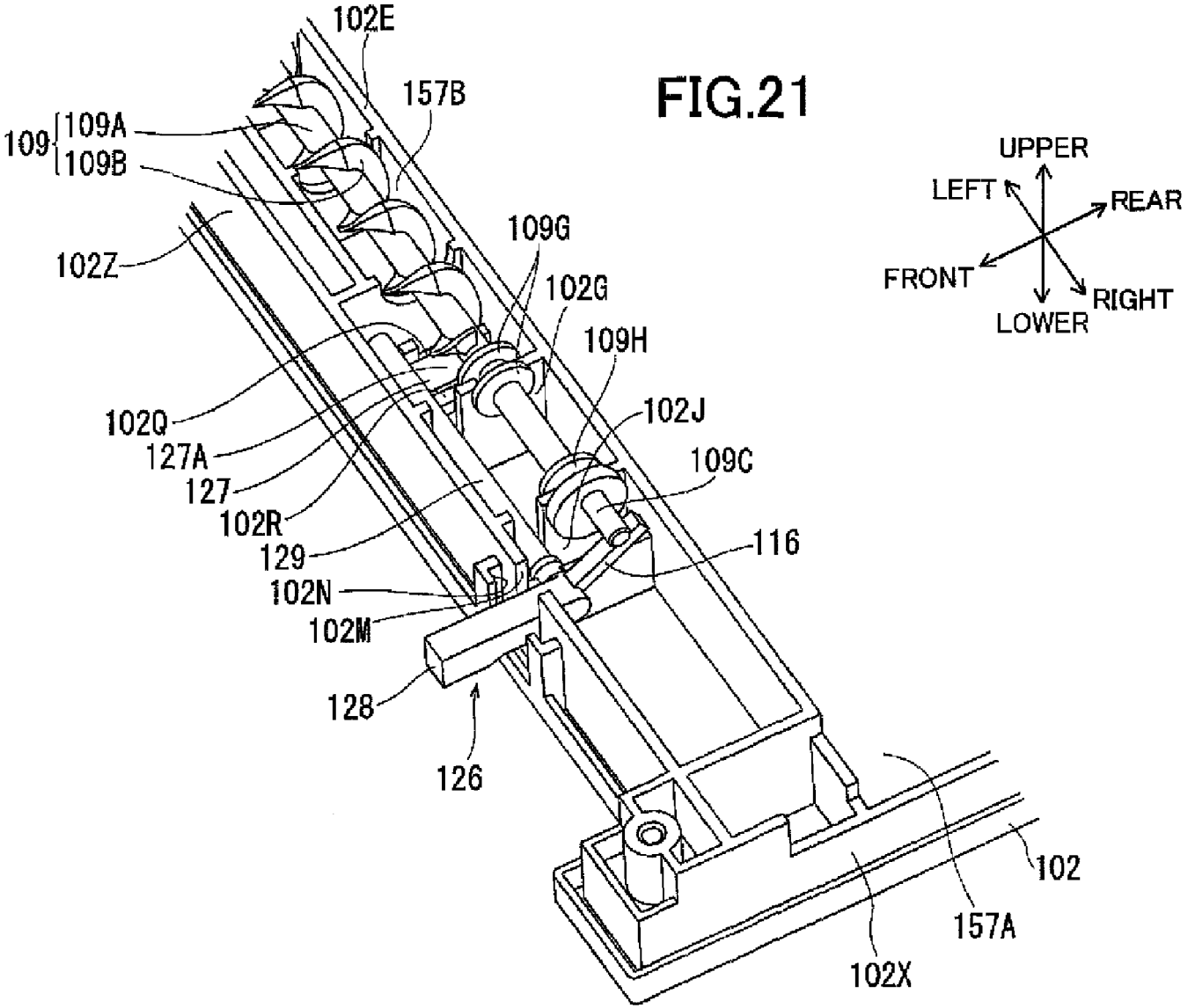
FIG. 21 is an enlarged perspective view of an essential portion of a waste toner collection unit according to a second embodiment of the present invention (in which a conveying screw and a moving member are shown)
Figure 22:
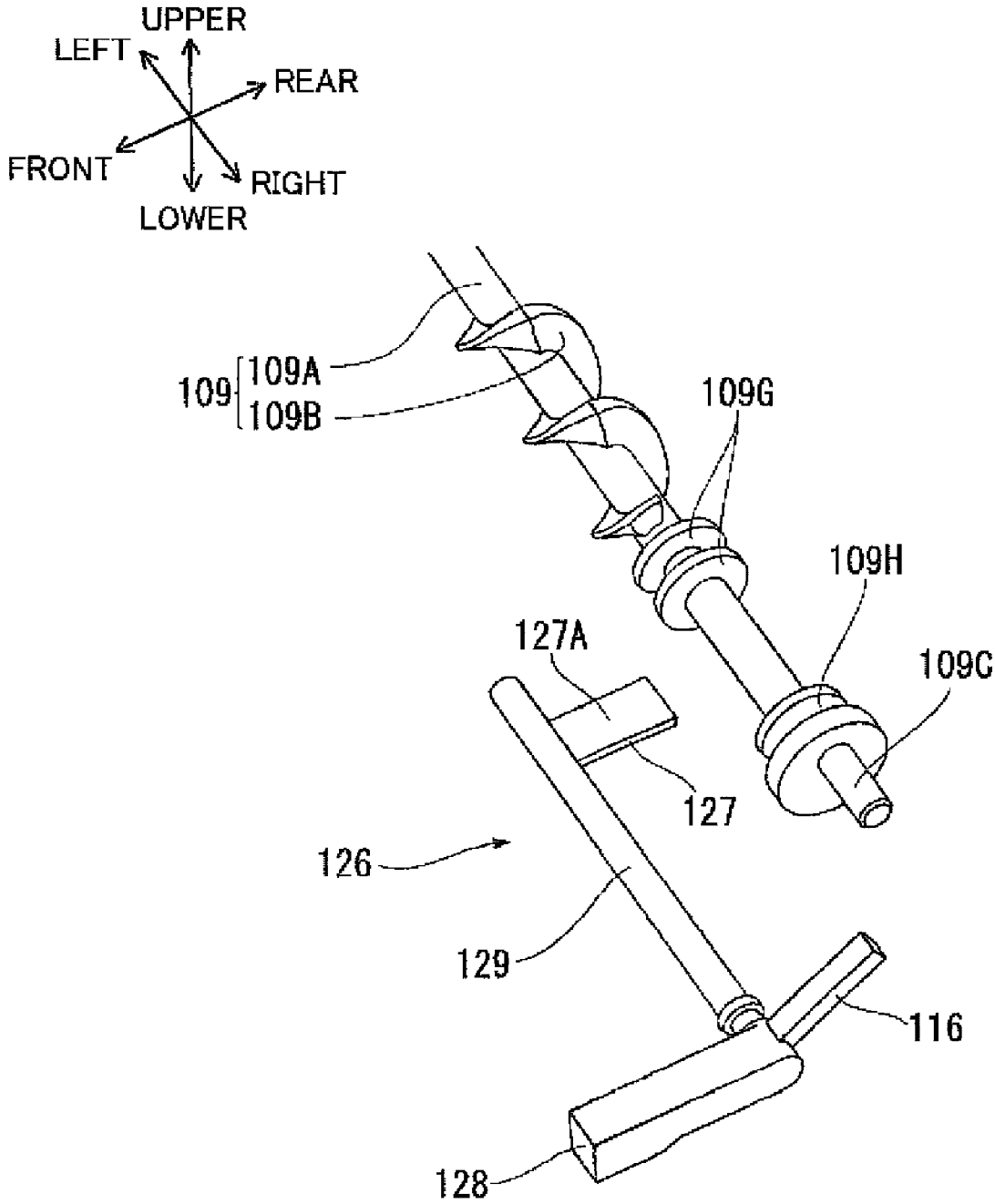
FIG. 22 is a perspective view separately showing the conveying screw and the moving member according to the second embodiment of the present invention.

Hereinafter, a second embodiment of the present invention will be described with reference to FIGS. 21 through 25. As shown in FIGS. 21 and 22, a printer according to the second embodiment employs a moving member 126 in place of the first moving member 110 and the second moving member 120 in the first embodiment. As to other components, the printer of the second embodiment has a configuration the same as that of the first embodiment. Hence, like parts and components are designated by the same reference numerals to avoid duplicating description.

The moving member 126 includes a power transmission section 116, a connecting section 129, a receiving section 127 and a shielding section 128. The connecting section 129 is formed in a rod-like shape having an axis extending in a direction parallel to the rotational shaft 109A. The connecting section 129 is rotatably supported by the partition walls 102G and 102H. The connecting section 129 has a right end extending to reach the eccentric shaft portion 109C in the left-to-right direction. The connecting section 129 has a right end that extends leftward, via the partition wall 102G, 103G, to the right end of the blade section 109B. The receiving section 127 has a plate shape, protruding from the left side portion of the connecting section 129 outward and rearward in a radial direction of the connecting section 129. As shown in FIG. 21, the receiving section 127 has a receiving surface 127A which faces upward. The receiving section 127 is assembled such that the receiving surface 127A is positioned below the right end of the blade section 109B. The shielding section 128 has an elongated prismatic columnar shape, protruding from the right end of the connecting section 129 outward in the radial direction the connecting section 129, and in a direction opposite to the direction in which the receiving section 127 extends (i.e., forward). The shielding section 128 protrudes further forward from the front side wall 102Z of the container main body 102 and the front side wall 103Z of the front upper cover 103 via the cutout portions 102M and 103M.

The power transmission section 116 has an elongated prismatic columnar shape, protruding from the right end of the connecting section 129 rearward, which is a direction opposite to the direction in which the shielding section 128 extends. The power transmission section 116 extends toward a position below the eccentric shaft portion 109C.

Figure 23:
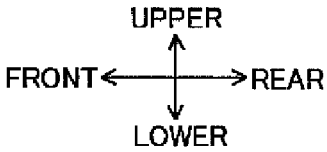
FIGS. 23 to 25 are enlarged cross-sectional views showing an essential portion of the waste toner collection unit according to the second embodiment of the present invention, explaining how the moving member moves in accordance with rotation of the conveying screw and accumulation of waste toner.
Figure 23:
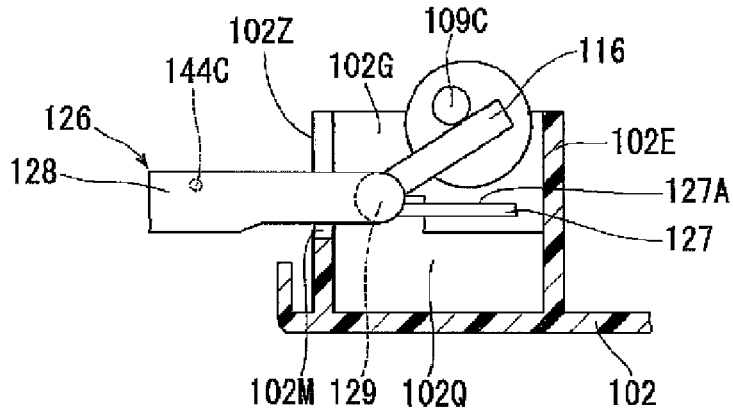
Figure 24:
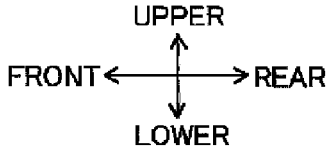
Figure 24:
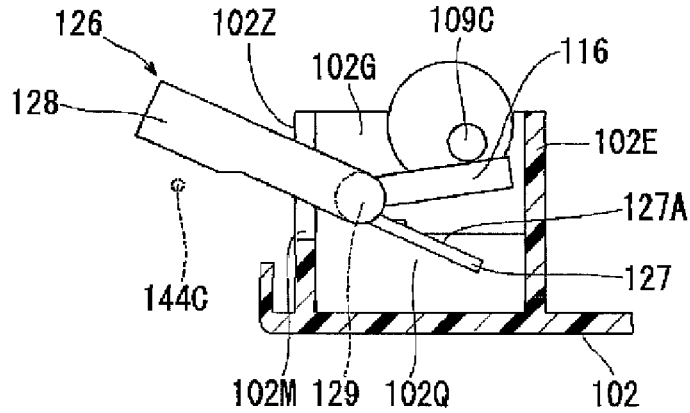
Figure 25:
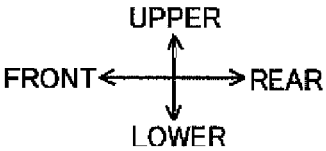
Figure 25:
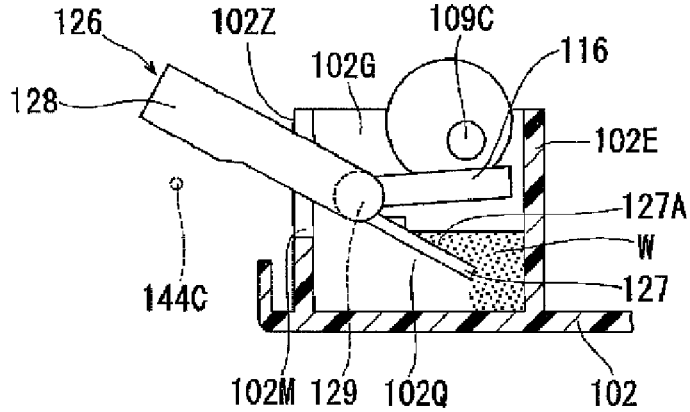

The shielding section 128 has a weight heavier than the total weight of the receiving section 127 and the power transmission section 116. Hence, the shielding section 128 tends to move down, while the receiving section 127 and the power transmission section 116 tend to move upward relative to the shielding section 128 until the waste toner W accumulates on the receiving surface 127A. Therefore, as shown in FIGS. 23 and 24, since the power transmission section 116 contacts the eccentric shaft portion 109C from below, the power transmission section 116 cyclically pivotally moves in the up-to-down direction in accordance with the eccentric rotation of the eccentric shaft portion 109C. In response, the receiving section 127 also periodically pivotally moves in the up-to-down direction, via the connecting section 129, in a phase the same as the power transmission section 116. The shielding section 128, however, periodically pivotally moves in the up-to-down direction, via the connecting section 129, in a phase opposite from the power transmission section 116. As a result, the shielding section 128 switches a location thereof between a position where the light path 144C is blocked (a lowermost position as shown in FIG. 23) and a position where the light path 144C is not blocked (an uppermost position as shown in FIGS. 24 and 25). In other words, the shielding section 128 blocks the light path 144C once as the eccentric shaft portion 109C makes one rotation.

When the waste toner W has been accumulated on the receiving surface 127A as shown in FIG. 25, the balance between the shielding section 128, and the receiving section 127 and the power transmission section 116 is changed, causing the receiving section 127 and the power transmission section 116 to move downward. As a result, the receiving section 127 and the power transmission section 116 are moved downward to be held at respective positions located lower than otherwise (before) and the power transmission section 116 is free from the eccentric rotation of the eccentric shaft portion 109C, while the shielding section 128 is urged to move upward and is held at the upper position. At this time, the light path 144C is released by the shielding section 128.

As long as the shielding section 128 cyclically blocks the light path 144C as shown in FIGS. 23 and 24, the optical sensor 144 outputs a cyclically alternating signal waveform, which is similar to the one shown in FIG. 16. When the shielding section 128 is held at the upper position where the light path 144C is released as shown in FIG. 25, the optical sensor 144 outputs the signal waveform that does not change but remains constant at the 'Low' state as shown in FIG. 18. Hence, the CPU 208 can make an accurate determination on whether or not the waste toner W has been accumulated enough up to the predetermined accumulation level ('near full') based on the distinctly different patterns of the signal waveforms. Further, when the shielding section 128 is held at the upper position where the light path 144C is left open as shown in FIG. 25, the power transmission section 116 separates from the eccentric shaft portion 109C.

Effects of Second Embodiment

The printer of the second embodiment can achieve advantageous technical effects the same as those of the printer 1 of the first embodiment.

Further, since the power transmission section 116 and the moving member 126 are formed as one member, number of parts constituting the printer 1 of the second embodiment can be reduced. At the same time, the waste toner W accumulated on the receiving surface 127A causes the balance among the receiving section 127 and the shielding section 128 and the power transmission section 116 to change, which easily enables the shielding section 128 to release the light path 144C while shutting off the transmission of the driving force by the power transmission section 116. Hence, the overall configuration of the printer can be simplified.

While the invention has been described in detail with reference to the specific embodiment thereof, it would be apparent to those skilled in the art that various changes and modifications may be made therein without departing from the spirit of the invention.

For example, the first moving member 110 and the second moving member 120 may be disposed at a position adjacent to the rear end portion of grid-like member 107. In this case, the first receiving section 111 is engaged with the rear end portion of the grid-like member 107 and makes periodical pivotal movements. When the waste toner accumulates up to the rear end portion of the grid-like member 107, the second receiving section 121 moves in response to the accumulation of the waste toner. This configuration can realize technical effects the same as the present embodiment.

Further, the determination program shown in FIG. 20 may not necessarily be executed all the time as in the present embodiment. Instead, the determination program may be configured to be executed only for a prescribed period of time when the printer 1 starts image forming operations, or alternatively, to be executed on a periodic basis as long as the power transmission mechanism 190 is in operation.

In the second embodiment, the light path 144C is released by the shielding section 128 when the waste toner W has been accumulated on the receiving surface 127A, the receiving section 127 and the power transmission section 116 are moved downward and the shielding section 128 is held at the upper position. However, the light path 144C may be blocked by the shielding section 128 when the waste toner W has been accumulated on the receiving surface 127A, the receiving section 127 and the power transmission section 116 are moved downward and the shielding section 128 is held at the upper position. In this case, the optical sensor 144 outputs the signal waveform that does not change but remains constant at the 'Hi' state as shown in FIG. 19. Hence, the CPU 208 can make an accurate determination on whether or not the waste toner W has been accumulated enough up to the predetermined accumulation level ('near full') based on the distinctly different patterns of the signal waveforms.

What is claimed is:

1. An image forming apparatus comprising:

an image forming unit configured to transfer toner onto a recording medium to form an image thereon;

a toner container configured to collect toner not transferred on the recording medium;

a driving force supplying unit configured to supply a driving force;

a toner conveying unit configured to receive the driving force from the driving force supplying unit and move to convey the toner accumulated in the toner container;

a first moving member that is provided in conjunction with the toner container and moves in accordance with the movement of the toner conveying unit;

a second moving member that is provided in conjunction with the toner container and moves in accordance with an amount of the toner accumulated in the toner container, the toner conveying unit conveying the toner toward the second moving member;

a detecting unit configured to output a detection signal that changes depending on the movements of the first moving member and the second moving member; and a determining unit configured to determine, based on the detection signal, whether at least one of the driving force supplying unit and the toner conveying unit is in an abnormal condition and whether the amount of the toner accumulated in the toner container has reached a predetermined accumulation level, wherein the detecting unit comprises a light emitting portion configured to emit a light and a light receiving portion configured to receive the light emitted from the light emitting portion, a light path being formed between the light emitting portion and the light receiving portion, wherein the first moving member comprises a first shielding section configured to periodically move between a first position blocking the light path and a second position allowing the light path to be formed between the light emitting portion and the light receiving portion, and wherein the second moving member comprises a second shielding section configured to integrally move with the first shielding section between a third position blocking the light path and a fourth position allowing the light path to be formed between the light emitting portion and the light receiving portion if the amount of the toner accumulated in the toner container fails to reach a predetermined accumulation level, and configured to separate from the first shielding section and to be positioned at the fourth position if the amount of the toner accumulated in the toner container has reached a predetermined accumulation level.

2. The image forming apparatus according to claim 1, wherein the first moving member comprises:

a first receiving section that is engaged with the toner conveying unit to receive a moving force thereof;

the first shielding section that periodically moves in a vertical direction in conjunction with the movement of the toner conveying unit via the first receiving section; and a first connecting section that connects the first receiving section and the first shielding section, wherein the second moving member comprises:

a second receiving section that is configured to accumulate the toner accumulated in the toner container;

the second shielding section that has a weight, is located above the first shielding section and is configured to contact the first shielding section from above by the weight; and a second connecting section that connects the second receiving section and the second shielding section, wherein the second receiving section is configured to move with the movement of the second shielding section in the vertical direction between a fifth position and a sixth position located below the fifth position, the second receiving section being configured to move between the fifth position and the sixth position if an amount of the toner accumulated on the second receiving section fails to exceed a predefined amount, and configured to be positioned at the sixth position if the amount of the toner accumulated on the second receiving section has exceeded the predefined amount, and wherein the second shielding section is configured to periodically integrally move with the first shielding section in the vertical direction between the third position and the fourth position if the second receiving section is movable between the fifth position and the sixth position, and the second shielding section is configured to separate from the first shielding section and to be positioned at the fourth position if the second receiving section is positioned at the sixth position.

3. The image forming apparatus according to claim 2, wherein the second shielding section is formed with a notch portion opened toward a lower side of the second shielding section, the first shielding section being configured to be completely accommodated within the notch portion when the second shielding section is in contact with the first shielding section.

4. The image forming apparatus according to claim 1, wherein the toner conveying unit conveys the toner in a toner conveying direction, wherein the second connecting section extends from the second receiving section toward a downstream side in the toner conveying direction, and wherein the first shielding section and the second shielding section separate from the second receiving section and are located on the downstream side in the toner conveying direction with respect to the second receiving section.

5. The image forming apparatus according to claim 4, wherein the toner container is provided with a partition wall interposed between the second receiving section, and the first shielding section and the second shielding section, the partition wall dividing an internal space of the toner container into a first space in which the second receiving section is located and a second space in which the first shielding section and the second shielding section are located.

6. The image forming apparatus according to claim 1, wherein the first shielding section and the second shielding section are respectively formed in a size such that a first period is shorter than a second period, the first period being a single period of time required for the first shielding section and the second shielding section to integrally block the light path for one time when the first shielding section periodically moves with the second shielding section, the second period being a single period of time required for the first shielding section only to block the light path for one time when only the first shielding section periodically moves.

7. The image forming apparatus according to claim 1, wherein the detection signal having a waveform defined by at least one of a first level and a second level, the first level representing that the light path is blocked, and the second level representing that the light path is formed between the light emitting portion and the light receiving portion;

wherein the determining unit determines that at least one of the driving force supplying unit and the toner conveying unit is in the abnormal condition when the signal waveform includes only the first level or only the second level, wherein the determining unit determines that the driving force supplying unit and the toner conveying unit are in a normal condition when the signal waveform includes a cyclical change of the first level and the second level, wherein the determining unit determines that the amount of the toner accumulated in the toner container fails to reach the predetermined accumulation level when the signal waveform includes the cyclical change and a single duration time of the first level is longer than a threshold value, and wherein the determining unit determines that the amount of the toner accumulated in the toner container has reached the predetermined accumulation level when the signal waveform includes the cyclical change and the single duration time of the first level is shorter than the threshold value.

8. The image forming apparatus according to claim 1, further comprising a housing and a toner collecting unit that is detachably mounted on the housing and includes the toner container, the driving force supplying unit, the toner conveying unit, the first moving member and the second moving member, wherein the detecting unit and the determining unit are provided on the housing.

9. An image forming apparatus comprising:

an image forming unit configured to transfer toner onto a recording medium to form an image thereon;

a toner container configured to collect toner not transferred on the recording medium;

a driving force supplying unit configured to supply a driving force;

a toner conveying unit configured to receive the driving force from the driving force supplying unit and move to convey the toner accumulated in the toner container;

a driving force transmission unit configured to receive the driving force via the toner conveying unit;

a moving member that is provided in conjunction with the toner container and is driven by the driving force transmission unit to move in accordance with an amount of the toner accumulated in the toner container and the movement of the toner conveying unit, the toner conveying unit conveying the toner toward the moving member;

a detecting unit configured to output a detection result that changes depending on the movements of the moving member;

a determining unit configured to determine, based on the detection result, whether the amount of the toner accumulated in the toner container has reached a predetermined accumulation level, wherein the detecting unit comprises a light portion emitting configured to emit a light and a light receiving portion configured to receive the light emitted from the light emitting portion, a light path being formed between the light emitting portion and the light receiving portion, wherein the moving member comprises a receiving section, a shielding section that is configured to periodically move between a first position blocking the light path and a second position allowing the light path to be formed between the light emitting portion and the light receiving portion, and a connecting section that connects the receiving section and the shielding section, wherein the receiving section is configured to periodically move between a third position and a fourth position by being driven by the driving force transmission unit if the amount of the toner accumulated in the toner container fails to reach a predetermined accumulation level, and the receiving section is configured to be positioned at the fourth position without being driven by the driving force transmission unit if the amount of the toner accumulated in the toner container has reached a predetermined accumulation level, and wherein the shielding section is configured to move in conjunction with the movement of the receiving section to periodically block the light path if the receiving section is movable between the third position and the fourth position, and the shielding section is configured to be positioned at either one of the first position and the second position if the receiving section is positioned at the fourth position.

10. The image forming apparatus according to claim 9, wherein the driving force transmission unit is connected to the receiving section and the shielding section via the connecting section and is configured to contact and separate from the toner conveying unit, the driving force transmission unit contacting the toner conveying unit to periodically move in conjunction with the movement of the toner conveying unit, wherein the receiving section moves in a vertical direction in conjunction with the movement of the driving force transmission unit, the receiving section having an accumulation surface that is configured to accumulate the toner accumulated in the toner container, the receiving section being configured to move between the third position and the fourth position located below the third position if an amount of the toner accumulated on the accumulation surface fails to exceed a predefined amount, and configured to be positioned at the fourth position if the amount of the toner accumulated on the accumulation surface has exceeded the predefined amount, wherein the shielding section moves between the first position and the second position in conjunction with the movements of the receiving section and the driving force transmission unit, and wherein, when the receiving section is positioned at the fourth position, the driving force transmission unit separates from the toner conveying unit and the shielding section is positioned at the second position.

11. The image forming apparatus according to claim 10, wherein the toner container is provided with a pair of restriction walls interposing the accumulation surface therebetween in the toner conveying direction, the restriction walls restricting the toner accumulated on the accumulation surface from flowing around the receiving section.

12. The image forming apparatus according to claim 9, wherein the driving force transmission unit is provided independently of the moving member and is engaged with the toner conveying unit to periodically move in a vertical direction, wherein the shielding section is located above the driving force transmission unit and is configured to contact the driving force transmission unit from above, the shielding section is configured to periodically integrally move with the driving force transmission unit between the first position and the second position in the vertical direction, wherein the receiving section has an accumulation surface that is configured to accumulate the toner accumulated in the toner container, the receiving section being configured to move between the third position and the fourth position located below the third position in the vertical direction in conjunction with the movement of the shielding section if an amount of the toner accumulated on the accumulation surface fails to exceed a predefined amount, and configured to be positioned at the fourth position if the amount of the toner accumulated on the accumulation surface has exceeded the predefined amount, and wherein the shielding section moves between the first position and the second position in conjunction with the movements of the receiving section and the driving force transmission unit, and wherein, when the receiving section is positioned at the fourth position, the shielding section separates from the driving force transmission unit and is positioned at the second position.

13. The image forming apparatus according to claim 9, wherein the toner conveying unit includes a conveying screw having a rotational shaft and a blade member formed on the rotational shaft so as to form a spiral around the rotational shaft, the conveying screw rotating about an axis of the rotational shaft to convey the toner toward the receiving section, wherein the moving member and the driving force transmission unit are disposed adjacent to the conveying screw.

14. The image forming apparatus according to claim 9, wherein toner conveying unit conveys the toner in a toner conveying direction, wherein the connecting section extends from the receiving section toward a downstream side in the toner conveying direction, and wherein the shielding section separates from the receiving section and is located on the downstream side in the toner conveying direction with respect to the receiving section.

15. The image forming apparatus according to claim 14, wherein the toner container is provided with a partition wall interposed between the receiving section and the shielding section, the partition wall dividing an internal space of the toner container into a first space in which the receiving section is located and a second space in which the shielding section is located.

16. The image forming apparatus according to claim 15, wherein the partition wall includes a plurality of walls arranged in the toner conveying direction, each of the walls being formed with a hole through which the toner passes.

17. The image forming apparatus according to claim 16, wherein the conveying screw penetrates the holes of the walls, and wherein the rotational shaft is provided with a pair of flange portions interposing one of the holes therebetween.

18. The image forming apparatus according to claim 9, further comprising a transparent cover that has a flange section, the light passing through the transparent cover, wherein the toner container has an outer wall formed with a groove portion, the shielding section protruding from the outer wall, the flange section of the transparent cover being engaged with the groove portion to cover the shielding section.

19. The image forming apparatus according to claim 9, further comprising a housing and a toner collecting unit that is detachably mounted on the housing and includes the toner container, the driving force supplying unit, the toner conveying unit, the driving force transmission unit, and the moving member, wherein the detecting unit and the determining unit are provided on the housing.

* * * * *